US009016226B2

(12) United States Patent
Smith

(10) Patent No.: US 9,016,226 B2
(45) Date of Patent: Apr. 28, 2015

(54) SUSPENDED MARINE PLATFORM

(76) Inventor: David Alvin Smith, Sidney (CA)

( * ) Notice: Subject to any disclaimer, the term of this patent is extended or adjusted under 35 U.S.C. 154(b) by 0 days.

(21) Appl. No.: 14/007,551

(22) PCT Filed: Mar. 29, 2012

(86) PCT No.: PCT/CA2012/000291
§ 371 (c)(1),
(2), (4) Date: Sep. 25, 2013

(87) PCT Pub. No.: WO2012/129665
PCT Pub. Date: Oct. 4, 2012

(65) Prior Publication Data
US 2014/0076787 A1 Mar. 20, 2014

Related U.S. Application Data

(60) Provisional application No. 61/469,514, filed on Mar. 30, 2011.

(51) Int. Cl.
*B63B 29/02* (2006.01)
*B03D 1/06* (2006.01)
*B03D 1/02* (2006.01)

(52) U.S. Cl.
CPC ... *B03D 1/06* (2013.01); *B03D 1/02* (2013.01)

(58) Field of Classification Search
CPC ..... B63B 29/12; B63B 17/0081
USPC ..... 114/122, 191, 192, 343, 364
See application file for complete search history.

(56) References Cited

U.S. PATENT DOCUMENTS

| | | | | |
|---|---|---|---|---|
| 4,349,167 | A | 9/1982 | Reilly | |
| 4,911,381 | A | 3/1990 | Cannon et al. | |
| 5,542,371 | A | 8/1996 | Harvey et al. | |
| 6,182,596 | B1 * | 2/2001 | Johnson | 114/284 |
| 6,237,889 | B1 | 5/2001 | Bischoff | |
| 6,786,172 | B1 | 9/2004 | Loffler | |
| 7,434,525 | B2 * | 10/2008 | Hodge | 114/71 |

FOREIGN PATENT DOCUMENTS

WO 92-12892 8/1992

OTHER PUBLICATIONS

Canadian Intellectual Property Office,International Search Report, Jun. 13, 2012, 2 pages.

* cited by examiner

*Primary Examiner* — Edwin Swinehart
(74) *Attorney, Agent, or Firm* — Tomlinson Rust McKinstry Grable

(57) ABSTRACT

A suspension system for passenger modules used with high-speed boats, the suspension system including a shock absorbing assembly, for supporting the passenger module relative to the vessel. The passenger module is attached to the vessel via an assembly of pivoting spars in which the vessel attachment locations are spaced athwart a greater distance than the passenger module attachment locations. The suspension system may include means for resisting relative lateral movement (e.g. a panhard rod or a Watt's linkage) and for attenuating motion associated with pitch and roll.

16 Claims, 30 Drawing Sheets

300
220
302
304

302
220

220
302
304
300

300

300

300

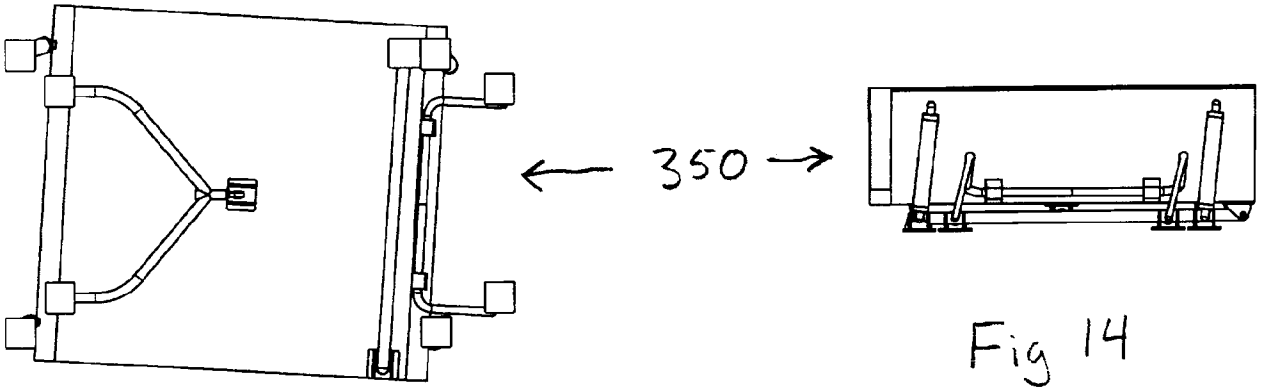
Fig 14
Fig 15
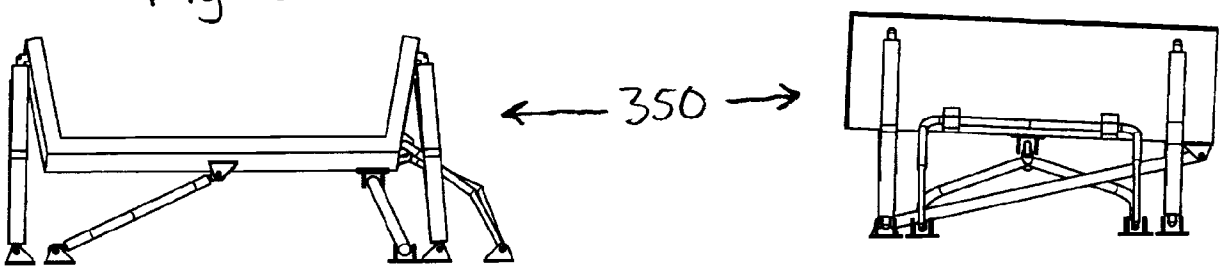
Fig 16
Fig 17

450

450

220
270
500

500

500

220
270
500

220
270
500

550

550

650
220
230
270

750
220
270
230
276

220
276
230
270
274
270
750

220
270
230
750

800
220
230
270

SUSPENDED MARINE PLATFORM

RELATED APPLICATION

This application claims the benefit of U.S. Provisional Application No. 61/469,514, filed 30 Mar. 2011.

FIELD OF THE INVENTION

The present invention relates to a suspended marine platform. More particularly, the present invention relates to a suspended marine platform for use in high-speed watercraft.

BACKGROUND OF THE INVENTION

High-speed small boats are used in a variety of applications and are particularly useful in military operations, and search and rescue operations. When fast-moving small watercraft encounter even moderately disturbed water, the passengers are subjected to significant forces. At high-speed, in waves of any appreciable size, small watercraft tend to be subjected to rapid and simultaneous vertical and horizontal acceleration and deceleration.

When a boat moving at high speed impacts the crest of a wave, the boat tends to simultaneously pitch upwards and decelerate, and when it passes over or through the crest and encounters the trough, the boat tends to pitch downwards and accelerate. At high speed, each pitching and acceleration/deceleration cycle may be measured in seconds, such that passengers are subjected to rapid and extreme acceleration and deceleration and the associated shock, which is commonly quantified in terms of multiples of g, a "g" being a unit of acceleration equivalent to that exerted by the earth's gravitational field at the surface of the earth. The term g-force is also often used, but it is commonly understood to mean a relatively long-term acceleration. A short-term acceleration is usually called a shock and is also quantified in terms of g.

Human tolerances for shock and g-force depend on the magnitude of the acceleration, the length of time it is applied, the direction in which it acts, the location of application, and the posture of the body. When vibration is experienced, relatively low peak g levels can be severely damaging if they are at the resonance frequency of organs and connective tissues. In high-speed watercraft, with the passengers sitting in a conventional generally upright position, which is typically required, particularly with respect to the helmsperson and any others charged with watchkeeping, upward acceleration of the watercraft is experienced as a compressive force to an individual's spine and rapid deceleration tends to throw an individual forward.

Shock absorbing systems for high-speed boats are known. For example, U.S. Pat. No. 6,786,172 (Loffler—Shock absorbing boat) discloses a horizontal base for supporting a steering station that that is hingedly connected to the transom to pivot about a horizontal axis. The base is supported by spring bias means connected to the hull.

Impact attenuation systems for aircraft seats are also known, as disclosed in: U.S. Pat. No. 4,349,167 (Reilly—Crash load attenuating passenger seat); U.S. Pat. No. 4,523,730 (Martin—Energy-absorbing seat arrangement); U.S. Pat. No. 4,911,381 (Cannon et al.—Energy absorbing leg assembly for aircraft passenger seats); U.S. Pat. No. 5,125,598 (Fox—Pivoting energy attenuating seat); and U.S. Pat. No. 5,152,578—Kiguchi—Leg structure of seat for absorbing impact energy.

Other seat suspension systems are also known, as disclosed in: U.S. Pat. No. 5,657,950 (Han et al.—Backward-leaning-movement seat leg structure); U.S. patent application Ser. No. 10/907,931 (App.) (Barackman et al.—Adjustable attenuation system for a space re-entry vehicle seat); U.S. Pat. No. 3,572,828 (Lehner—Seat for vehicle preferably agricultural vehicle); U.S. Pat. No. 3,994,469 (Swenson et al.—Seat suspension including improved damping means); and U.S. Pat. No. 4,047,759 (Koscinski—Compact seat suspension for lift truck).

SUMMARY OF THE INVENTION

In one aspect, the present invention provides for a suspension system for a suspended marine platform on a high-speed water vessel having a usual direction of travel, the suspension system including: a shock absorbing assembly for resiliently suspending a marine platform relative to a vessel, wherein the shock absorbing assembly tends to cause the passenger module to remain in an upper at-rest position and to return to the at-rest position on cessation of a force causing the passenger module to move generally vertically towards a bottom position; and a spar assembly comprising a first spar and a second spar, each spar pivotally attached at a proximal end to the vessel and at a distal end to the passenger module, wherein: the proximal ends are aft of the distal ends; and the proximal ends of the spars are spaced athwart one from the other a greater distance than the distal ends of the spars are spaced athwart one from the other.

The suspension system may include a second spar assembly, wherein one spar assembly is forward of the other spar assembly.

The first spar and second spar may be fixed one to the other in the vicinity of their distal ends and may share a common pivotal attachment to the passenger module.

The spar assembly may also include a third spar pivotally attached at a proximal end to the vessel and at a distal end to the passenger module, wherein the proximal end of the third spar is aft of the distal end of the third spar. The third spar may be generally parallel to the first spar or second spar. The spar to which the third spar is generally parallel, may be closer to the third spar than the other of the first spar and second spar. The spar to which the third spar is not generally parallel, may be located between the third spar and the other of the first spar and second spar.

The spar assembly may also include a third spar and a fourth spar, each pivotally attached at a proximal end to the vessel and at a distal end to the passenger module, wherein the third spar is adjacent to and parallel with one of the first spar and second spar and the fourth spar is adjacent to and parallel with the other of the first spar and second spar.

The suspension system may also include a roll-attenuation assembly interconnected between the marine platform and the vessel. The roll-attenuation assembly may include a longitudinally extending torsion bar mounted so as to extend athwart.

The suspension system may include a pitch-attenuation assembly interconnected between the marine platform and the vessel. The pitch-attenuation assembly may include a longitudinally extending torsion bar mounted so as to extend fore and aft.

The suspension system may include a panhard interconnected between the marine platform and the vessel so as to limit athwart movement of the marine platform relative to the vessel.

The suspension system may include a Watt's linkage interconnected between the marine platform and the vessel so as to limit athwart movement of the marine platform relative to the vessel.

The suspension system may include: a roll-attenuation assembly interconnected between the marine platform and the vessel; and a panhard interconnected between the marine platform and the vessel so as to limit athwart movement of the marine platform relative to the vessel.

The suspension system may include: a roll-attenuation assembly interconnected between the marine platform and the vessel; and a Watt's linkage interconnected between the marine platform and the vessel so as to limit athwart movement of the marine platform relative to the vessel.

The suspension system may include: a roll-attenuation assembly interconnected between the marine platform and the vessel; and a pitch-attenuation assembly interconnected between the marine platform and the vessel.

The spar assembly may include a third spar pivotally attached at a proximal end to the vessel and at a distal end to the passenger module, wherein the proximal end of the third spar is aft of the distal end of the third spar; and the suspension system may also include a roll-attenuation assembly interconnected between the marine platform and the vessel; and a pitch-attenuation assembly interconnected between the marine platform and the vessel.

The spar assembly may include a third spar and a fourth spar, each pivotally attached at a proximal end to the vessel and at a distal end to the passenger module, wherein the third spar is adjacent to and parallel with one of the first spar and second spar and the fourth spar is adjacent to and parallel with the other of the first spar and second spar; and the suspension system may also include a roll-attenuation assembly interconnected between the marine platform and the vessel; and a pitch-attenuation assembly interconnected between the marine platform and the vessel.

The shock absorbing assembly may include four shock-absorbing struts interconnected between the marine platform and the vessel.

SUMMARY OF THE DRAWINGS

FIG. 14 is a forward elevation view of the embodiment illustrated in FIG. 9, shown in a compressed position.

FIG. 15 is a bottom plan view of the embodiment illustrated in FIG. 9, shown in a compressed position.

FIG. 16 is a starboard-side elevation view of the embodiment illustrated in FIG. 9, shown in a rolled-to-port position.

FIG. 17 is a forward elevation view of the embodiment illustrated in FIG. 9, shown in a rolled-to-port position.

DETAILED DESCRIPTION WITH REFERENCE TO THE DRAWINGS

Figure 1:
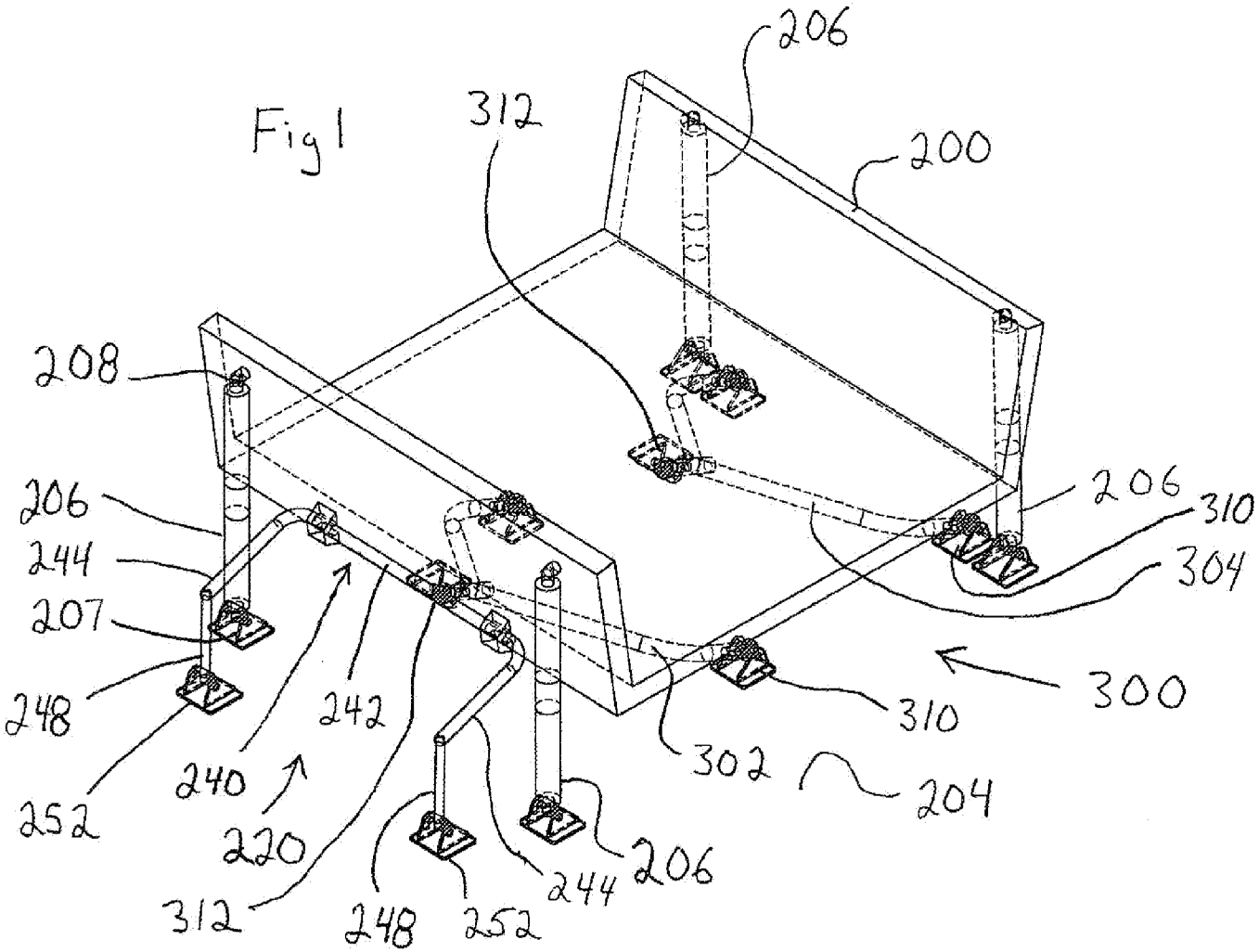
FIG. 1 is a forward-port-side isometric partially transparent view of a double-wishbone anti-sway embodiment of the present invention, shown in the at-rest position.

In this specification, including the claims, terms conveying an absolute direction (for example, up, down etc.) or absolute relative positions (for example, top, bottom etc.) are used for clarity of description and it is understood that such absolute directions and relative positions may not always pertain. As well, in this specification, including the claims, terms relating to directions and relative orientations on a watercraft, for example, port, starboard, forward, aft, fore and aft (which when used herein means a generally horizontal direction generally parallel to the direction of travel of the vessel), bow, stern, athwart (which when used herein means a generally horizontal direction generally perpendicular to the direction of travel of the vessel) etc. are used for clarity of description and it is understood that such terms may not always pertain.

As well, in this specification, including the claims, the terms "roll and "pitch" are used to refer to movement relative to an imaginary line parallel to the nominal direction of travel of the vessel or object, and passing through the center of mass of the vessel or object, with "roll" being quasi-pivotal or quasi-rotational lateral movement with respect to the imaginary line, and "pitch" being a generally vertical angle of displacement (e.g. bow up or bow down) caused by a vertical force applied at a distance from the center of mass.

In most of the figures, a marine platform 200 is represented in a simplified stylized manner, however it will be appreciated that in an actual installation, marine platform 200 may comprise several other features, including: contoured seats, windscreens, covers, vessel controls etc. As well, the passenger module may comprise a plurality of individual seats. Marine platform 200 may be configured for use with a variety of items. including a stretcher or stretchers, cargo, a cockpit, a pallet of seats, and may configured for interchangeable use with many different types of such items.

In the figures, a deck 204 is indicated as being below and providing support for the marine platform 200. In an actual installation, the marine platform 200 and the associated suspension system are typically mounted to the vessel, such as to an integral deck. However, in some installations, it may be preferable to mount the marine platform 200 and suspension system to a carriage (such as a suitable plate or framework) and to attach the carriage to the vessel.

The embodiments shown in the figures all have four shock absorbing struts 206, which serve to suspend marine platform 200 above deck 204, with each strut 206 shown as positioned in the general vicinity of an associated corner of the marine platform 200 and extending generally vertically. In the figures, each strut 206 is secured to deck 204 with a strut deck bracket 207 and to marine platform 200 with a strut module bracket 208. The struts 206 may be any suitable type of shock absorber such as air shocks, MacPherson struts etc. Further, there need not be exactly four struts 206; more or fewer struts 206 may be suitable in some applications.

Some of the embodiments shown in the drawings include a roll-attenuation assembly 220 and/or a pitch-attenuation assembly 230. The roll-attenuation assembly 220 and the pitch-attenuation assembly 230 share functionally analogous components and for convenience and simplicity herein such functionally analogous components are given the same descriptive terms and reference numbers, though it will be understood that such components may differ in many respects, including size, as between the roll-attenuation assembly 220 and the pitch-attenuation assembly 230.

Each of the roll-attenuation assembly 220 and the pitch-attenuation assembly 230 includes a torsion bar 240, comprising: a longitudinally extending torsion spring 242 having at each end a torsion arm 244 or an adjustable torsion arm 246, extending laterally from the torsion spring 242. The torsion arm 244 has a torsion arm mounting hole 247 in the vicinity of the end of the torsion arm 244 opposite the torsion spring 242. The adjustable torsion arm 246 has a plurality of torsion arm mounting holes 247 in the vicinity of the end of the adjustable torsion arm 246 opposite the torsion spring 242.

A torsion arm link 248 or adjustable torsion arm link 250 is pivotally connected to each of the torsion arm 244 and adjustable torsion arm 246 at a respective torsion arm mounting hole 247. At the end of each torsion arm link 248 or adjustable torsion arm link 250 opposite the connection to the torsion arm 244 or adjustable torsion arm 246, as the case may be, there is a link bracket 252, that in use is mounted to the marine platform 200 or deck 204 or other appropriate component.

Along the torsion spring 242, there are two torsion-bar mounts 254 for mounting the torsion bar 240 to the marine platform 200 or deck 204 or other appropriate component. The torsion-bar mounts 254 tend to impede longitudinal movement of the torsion spring 242 while permitting rotational movement of the torsion spring 242.

In use, the roll-attenuation assembly 220 is mounted with the relevant torsion spring 242 extending athwart. In use, the pitch-attenuation assembly 230 is mounted with the relevant torsion spring 242 extending fore and aft.

The roll-attenuation assembly 220 and pitch-attenuation assembly 230 function along the lines of a conventional anti-sway bar in that the roll-attenuation assembly 220 and pitch-attenuation assembly 230 impede differential relative vertical movement between the two sets of components between which the two ends of the roll-attenuation assembly 220 and pitch-attenuation assembly 230 are interconnected. The degree to which the roll-attenuation assembly 220 and pitch-attenuation assembly 230 impede such relative vertical movement (i.e., the "stiffness" of the roll-attenuation assembly 220 and pitch-attenuation assembly 230) depends on the size and characteristics of the torsion spring 242; and the distance between the axis of rotation of the torsion spring 242 and the connection between the torsion arm 244 or adjustable torsion arm 246 and the torsion arm link 248 or adjustable torsion arm link 250 (as the case may be). Therefore, the "stiffness" of the roll-attenuation assembly 220 and pitch-attenuation assembly 230 may be adjusted by changing the torsion spring 242, and by moving the location of the connection between the adjustable torsion arm 246 and the torsion arm link 248 or adjustable torsion arm link 250 (as the case may be) by moving the connection to a different one of the plurality of torsion arm mounting holes 247 provided in the adjustable torsion arm 246.

The adjustable torsion arm 246 includes a bottlescrew 260 so as to permit adjustment of the length of the adjustable torsion arm 246.

Some of the embodiments shown in the drawings include spars 270, pivotally connected between the marine platform 200 and deck 204, by way of spar brackets 272, spar clevis brackets 274 or spar clevis lateral brackets 276.

Figures 2, 3, 4, 5, 6, 7, 8:
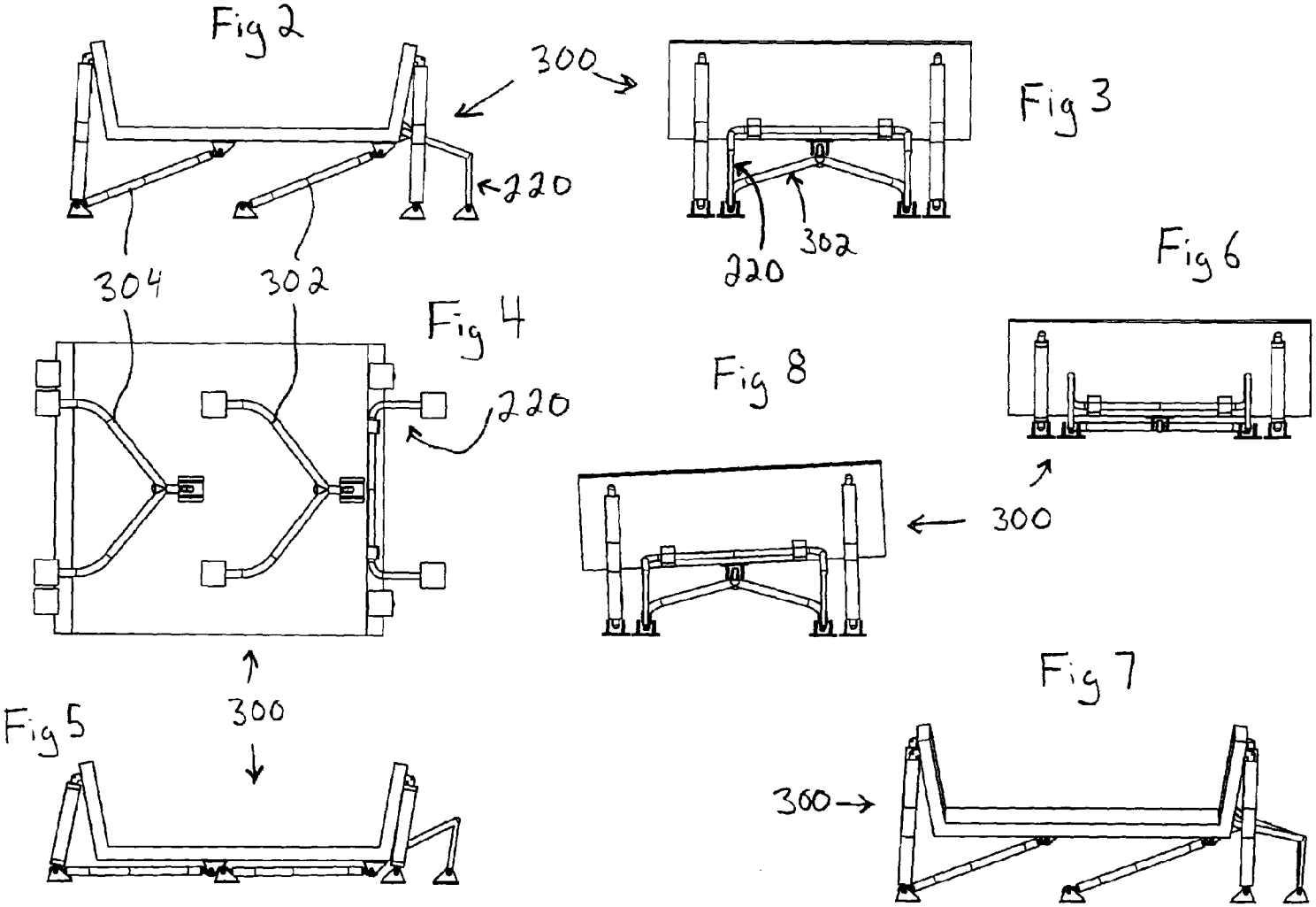
FIG. 2 is a starboard-side elevation view of the embodiment illustrated in FIG. 1, shown in the at-rest position.
FIG. 3 is a forward elevation view of the embodiment illustrated in FIG. 1, shown in the at-rest position.
FIG. 4 is a bottom plan view of the embodiment illustrated in FIG. 1, shown in the at-rest position.
FIG. 5 is a starboard-side elevation view of the embodiment illustrated in FIG. 1, shown in a compressed position.
FIG. 6 is a forward elevation view of the embodiment illustrated in FIG. 1, shown in a compressed position.
FIG. 7 is a starboard-side elevation view of the embodiment illustrated in FIG. 1, shown in a rolled-to-starboard position.
FIG. 8 is a forward elevation view of the embodiment illustrated in FIG. 1, shown in a rolled-to-starboard position.
Figure 9:
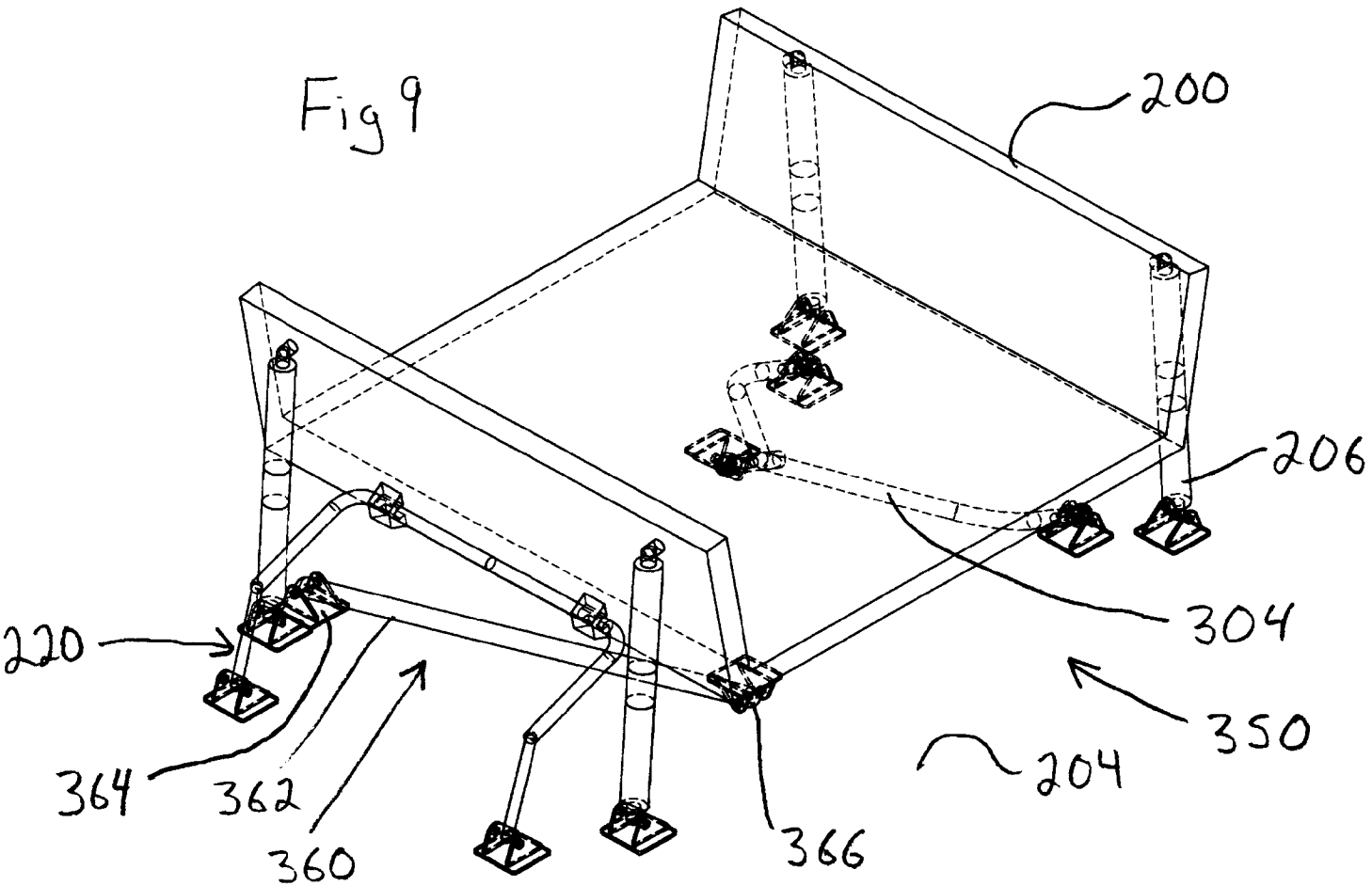
FIG. 9 is a forward-port-side isometric partially transparent view of a single-wishbone panhard anti-sway embodiment of the present invention, shown in the at-rest position.
Figure 11:
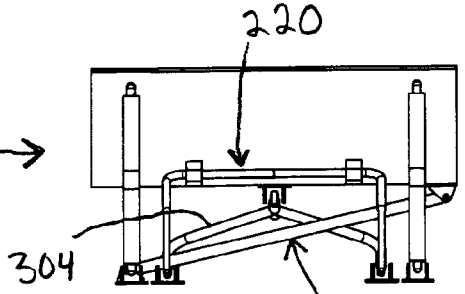
FIG. 11 is a forward elevation view of the embodiment illustrated in FIG. 9, shown in the at-rest position.
Figure 10:
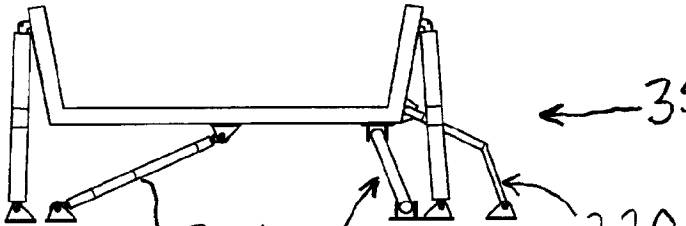
FIG. 10 is a starboard-side elevation view of the embodiment illustrated in FIG. 9, shown in the at-rest position.

In this specification, the term wishbone is used to refer to an assembly of two spars in which the two spars are fixed one to the other in the vicinity of the marine platform 200 and share a common pivotal attachment to the marine platform 200, being a wishbone platform bracket 312. Referring to FIGS. 1 through 8, there is illustrated an embodiment of the present invention comprising a marine platform 200 and an associated double-wishbone roll-attenuation suspension system, generally referenced by numeral 300, mounted to a deck 204. In FIGS. 1 through 4, the embodiment is shown with the marine platform 200 in a no-load at-rest position. In FIGS. 5 and 6, the embodiment is shown with the marine platform 200 in a compressed bottom position. In FIGS. 7 and 8, the embodiment is shown with the marine platform 200 rolled to starboard relative to the deck 204.

In the embodiment shown in FIGS. 1 through 8, the double-wishbone roll-attenuation suspension system 300, includes four struts 206, a forward wishbone 302, an aft wishbone 304, and a roll-attenuation assembly 220.

As shown in the figures, each of the forward wishbone 302 and aft wishbone 304 is pivotally attached to the deck 204 with two wishbone deck brackets 310 and is pivotally attached to the marine platform 200 with a wishbone platform bracket 312. The joint between each wishbone platform bracket 312 and the respective forward wishbone 302 and aft wishbone 304 is configured to prevent some lateral pivotally movement so as to accommodate rolling of the marine platform 200 relative to the deck 204 when in use.

In use, fast-moving relatively small watercraft are subject to complicated forces that cause the vessels to pitch, yaw, roll, rise, fall, decelerate and accelerate. The response of the double-wishbone anti-sway suspension system 210 embodiment to such forces is indicated in FIGS. 5 through 8.

Figure 13:
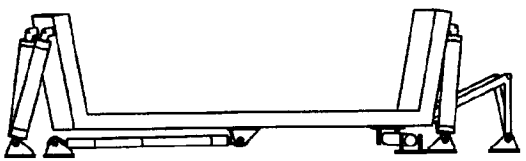
FIG. 13 is a starboard-side elevation view of the embodiment illustrated in FIG. 9, shown in a compressed position.
Figure 12:
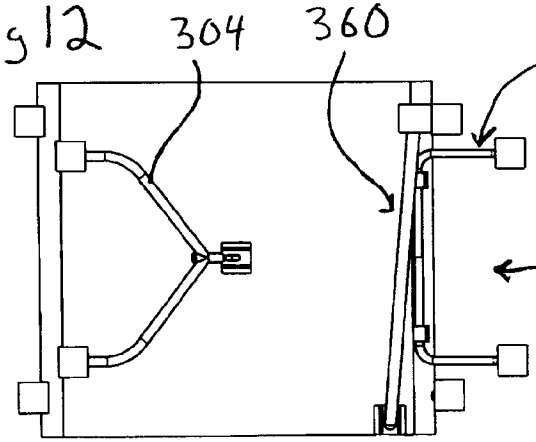
FIG. 12 is a bottom plan view of the embodiment illustrated in FIG. 9, shown in the at-rest position.

Referring to FIGS. 9 through 17, there is illustrated an embodiment of the present invention comprising a marine platform 200 and an associated single-wishbone panhard roll-attenuation suspension system, generally referenced by numeral 350, mounted to a deck 204. In FIGS. 9 through 12, the embodiment is shown with the marine platform 200 in a no-load at-rest position. In FIGS. 13 through 15, the embodiment is shown with the marine platform 200 in a compressed bottom position. In FIGS. 16 and 17, the embodiment is shown with the marine platform 200 rolled to port relative to the deck 204.

In the embodiment shown in FIGS. 9 through 17, the single-wishbone panhard roll-attenuation suspension system 350, includes four struts 206, an aft wishbone 304, a roll-attenuation assembly 220 and a panhard assembly 360. The aft wishbone 214 is configured and mounted as described above.

The panhard assembly 360 comprises a panhard rod 362, a panhard deck mount 364 and a panhard platform mount 366. The proximal end of the panhard rod 362 is pivotally mounted to the deck 204 with the panhard deck mount 364. The distal end of the panhard rod 362 is pivotally mounted to the marine platform 200 with the panhard platform mount 366.

In the embodiment shown in FIGS. 9 through 17, the panhard assembly 360 is positioned in the vicinity of the forward end of marine platform 200. The panhard assembly 360 prevents more than minimal lateral movement of marine platform 200 relative to deck 204. As the distal end of panhard rod 362 moves in an arc as marine platform 200 moves vertically relative to the deck 204, panhard rod 360 induces a slight lateral movement of marine platform 200 during vertical movement of marine platform 200. This slight lateral movement of marine platform 200 relative to deck 204 is accommodated generally by the various connections between the components of embodiment being configured to permit some relative lateral movement.

Figure 18:
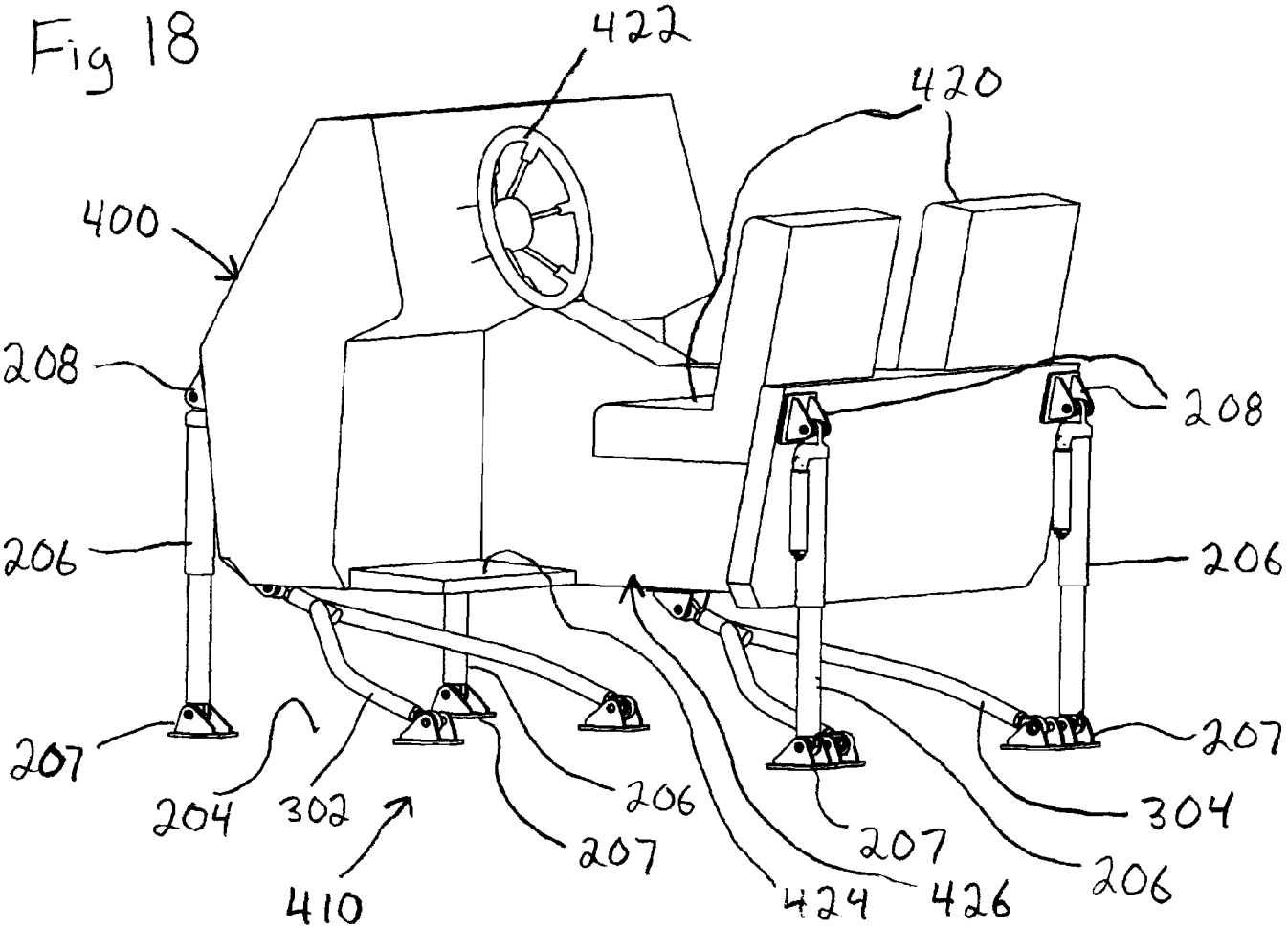
FIG. 18 is a rear-port-side isometric view of a control-module double-wishbone embodiment of the present invention, shown in the at-rest position.
Figure 19:
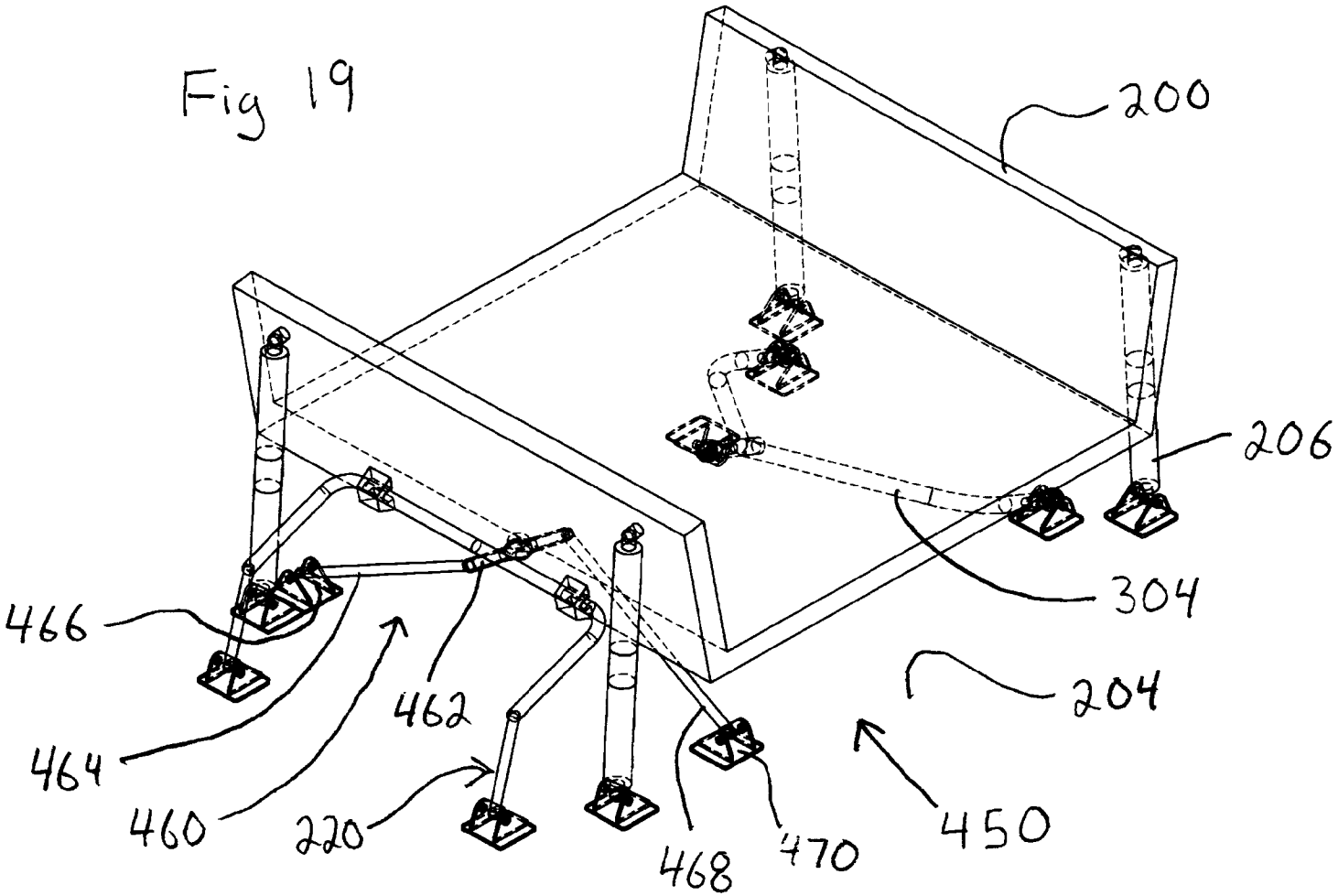
FIG. 19 is a forward-port-side isometric partially transparent view of a single-wishbone Watt's linkage anti-sway embodiment of the present invention, shown in the at-rest position.
Figure 21:
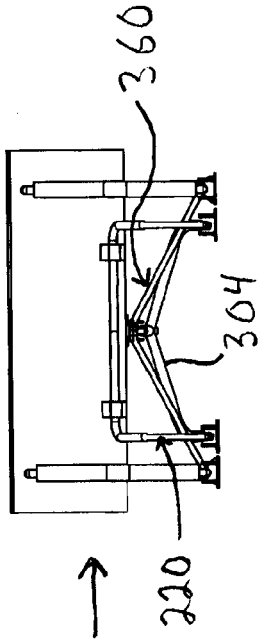
FIG. 21 is a forward elevation view of the embodiment illustrated in FIG. 19, shown in the at-rest position.

Referring to FIG. 18, there is illustrated an embodiment of the present invention comprising a control module 400, and a double-wishbone suspension system, generally referenced by numeral 410, mounted to a deck 204.

The control module 400 comprises two seats 420, a helm/control station 422, two foot rests 424 (one on the port side and the other on the starboard side; only one is visible in the drawing) and two foot openings 426 (again, one on the port side and the other on the starboard side; only one is visible in the drawing). The foot openings 426 permit users to selectively stand on the deck 204 or sit on the seats 420 while controlling the vessel or while being partially sheltered from spray by the control module 400.

In the embodiment shown in FIG. 18, the double-wishbone suspension system 410, includes four struts 206, a forward wishbone 302 and an aft wishbone 304.

Figure 23:
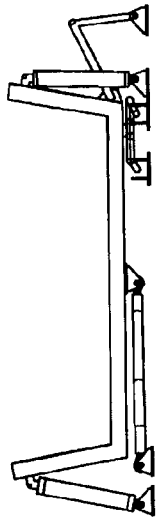
FIG. 23 is a starboard-side elevation view of the embodiment illustrated in FIG. 19, shown in a compressed position.
Figure 20:
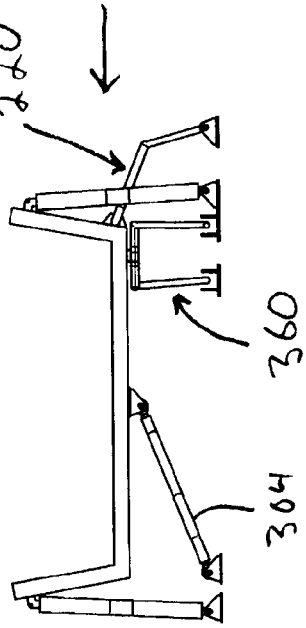
FIG. 20 is a starboard-side elevation view of the embodiment illustrated in FIG. 19, shown in the at-rest position.
Figure 22:
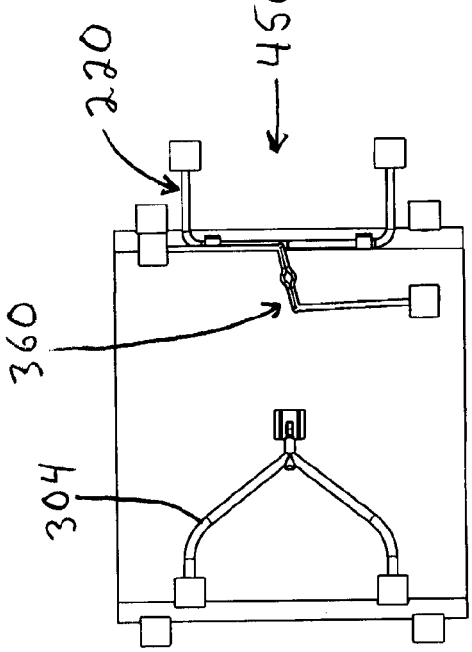
FIG. 22 is a bottom plan view of the embodiment illustrated in FIG. 19, shown in the at-rest position.
Figure 24:
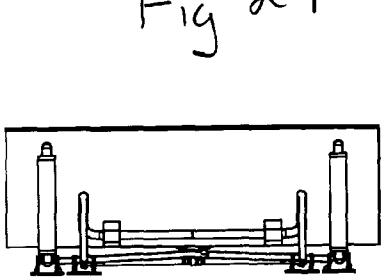
FIG. 24 is a forward elevation view of the embodiment illustrated in FIG. 19, shown in a compressed position.
Figure 25:
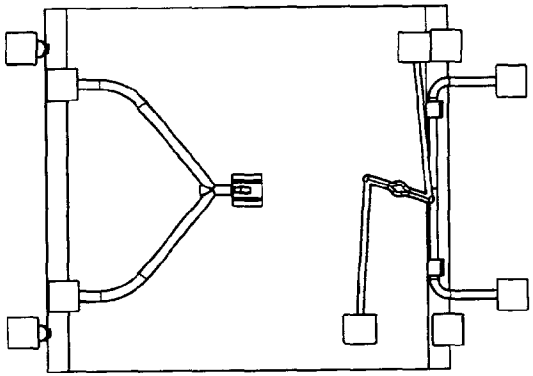
FIG. 25 is a bottom plan view of the embodiment illustrated in FIG. 19, shown in a compressed position.
Figure 27:
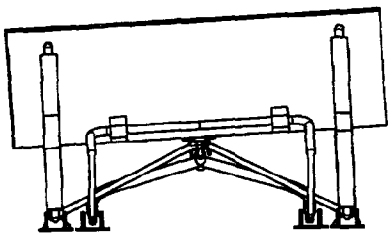
FIG. 27 is a forward elevation view of the embodiment illustrated in FIG. 19, shown in a rolled-to-starboard position.
Figure 26:
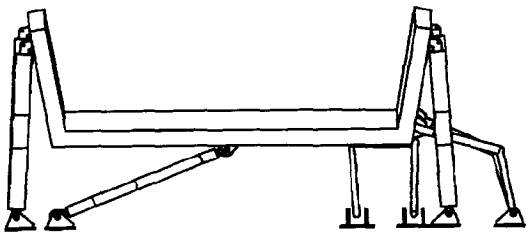
FIG. 26 is a starboard-side elevation view of the embodiment illustrated in FIG. 19, shown in a rolled-to-starboard position.
Figure 28:
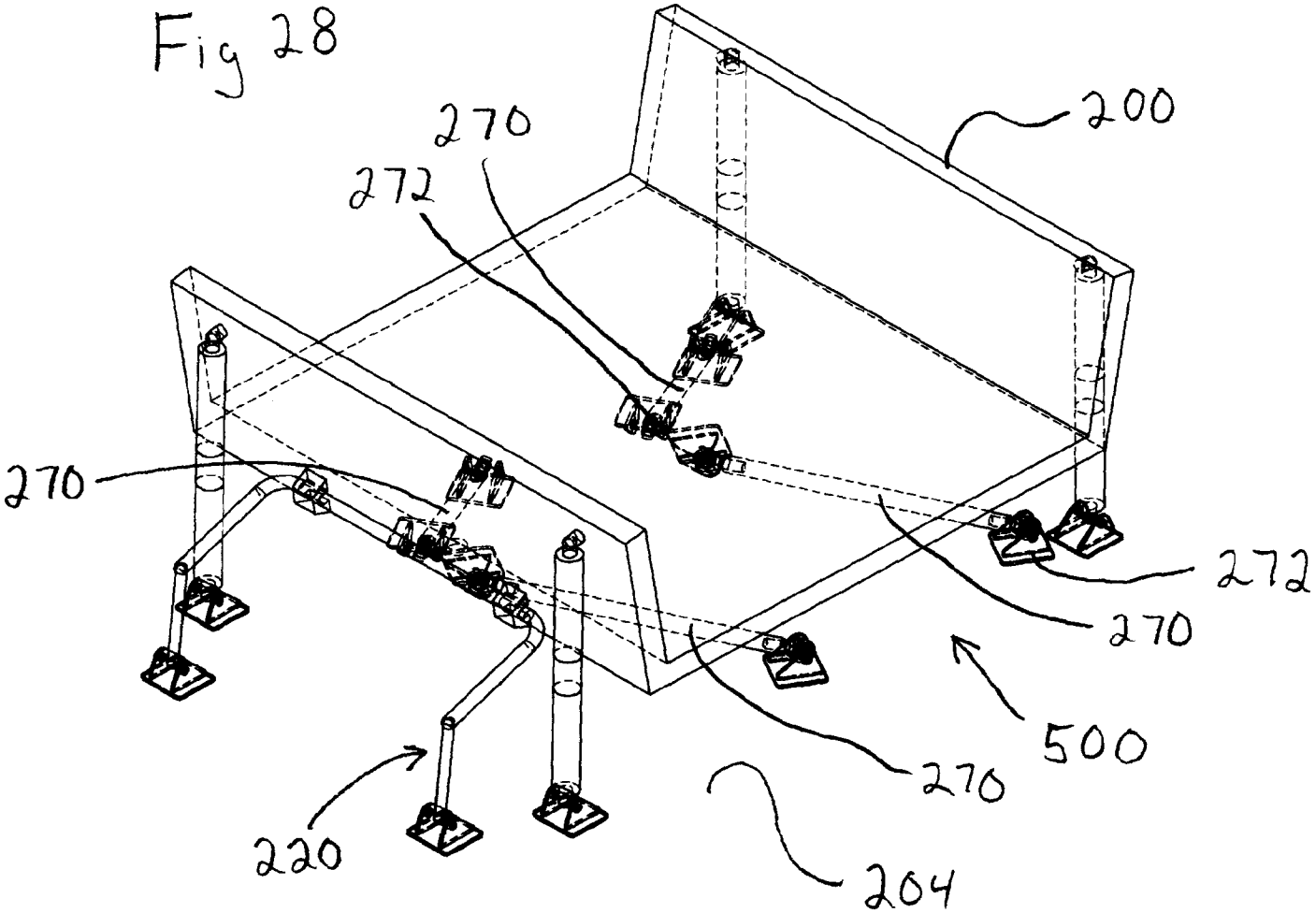
FIG. 28 is a forward-port-side isometric partially transparent view of a double two-spar roll-attenuation embodiment of the present invention, shown in the at-rest position.

Referring to FIGS. 19 through 27, there is illustrated an embodiment of the present invention comprising a marine platform 200 and an associated single-wishbone Watt's linkage roll-attenuation suspension system, generally referenced by numeral 450, mounted to a deck 204. In FIGS. 19 through 22, the embodiment is shown with the marine platform 200 in a no-load at-rest position. In FIGS. 23 through 25, the embodiment is shown with the marine platform 200 in a compressed bottom position. In FIGS. 26 and 27, the embodiment is shown with the marine platform 200 rolled to starboard relative to the deck 204.

In the embodiment shown in FIGS. 19 through 27, the single-wishbone Watt's linkage roll-attenuation suspension system 450, includes four struts 206, an aft wishbone 214, a roll-attenuation assembly 222 and a Watt's linkage 460.

The Watt's linkage 460 embodiment shown in the drawings comprises a Watt's link 462 rotatably mounted to the marine platform 200; a starboard Watt's rod 464 attached at one end to the Watt's link 462 and attached at the other end to the deck 204 via a starboard Watt's rod deck mount 466; and a port Watt's rod 468 attached at one end to the Watt's link 462 (opposite the location of attachment of the starboard Watt's rod 464) and attached at the other end to the deck 204 via a port Watt's rod deck mount 470.

The Watt's linkage 460 permits vertical movement of the marine platform 200 relative to the deck 204, with minimal lateral movement of the marine platform 200 relative to the deck 204.

Figures 29, 30, 31, 32, 33, 34, 35:
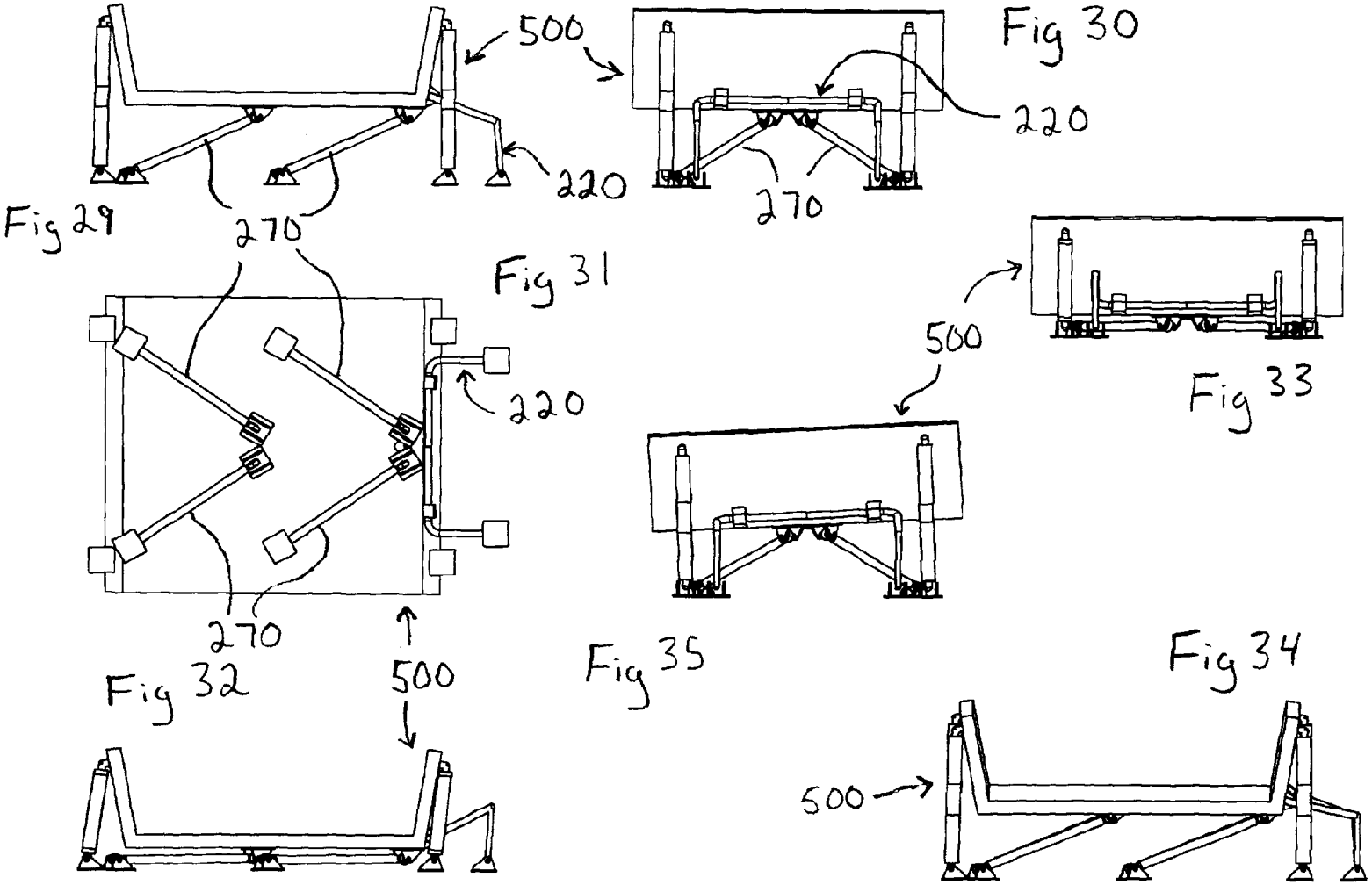
FIG. 29 is a starboard-side elevation view of the embodiment illustrated in FIG. 28, shown in the at-rest position.
FIG. 30 is a forward elevation view of the embodiment illustrated in FIG. 28, shown in the at-rest position.
FIG. 31 is a bottom plan view of the embodiment illustrated in FIG. 28, shown in the at-rest position.
FIG. 32 is a starboard-side elevation view of the embodiment illustrated in FIG. 28, shown in a compressed position.
FIG. 33 is a forward elevation view of the embodiment illustrated in FIG. 28, shown in a compressed position.
FIG. 34 is a starboard-side elevation view of the embodiment illustrated in FIG. 28, shown in a rolled-to-starboard position.
FIG. 35 is a forward elevation view of the embodiment illustrated in FIG. 28, shown in a rolled-to-starboard position.
Figure 36:
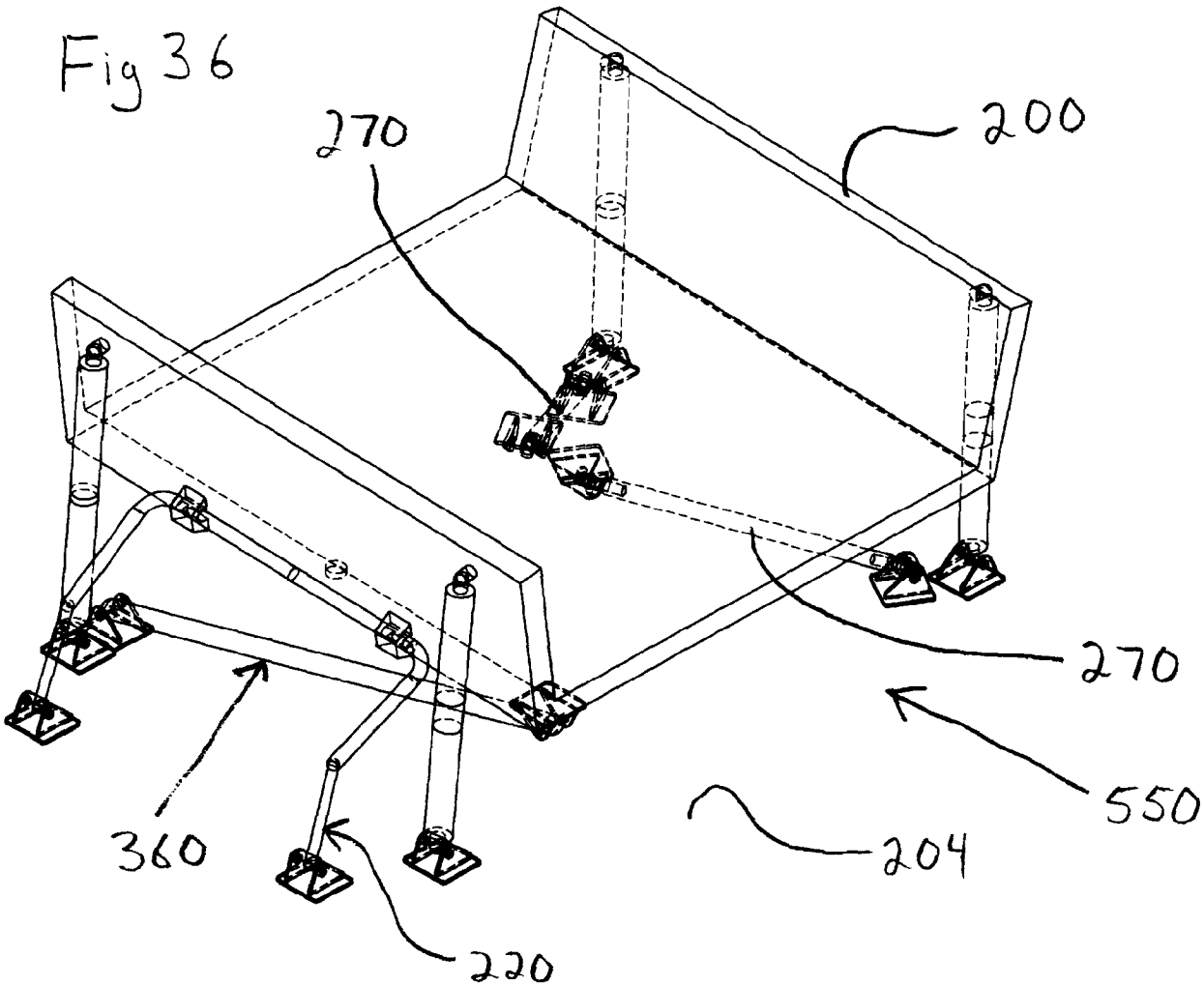
FIG. 36 is a forward-port-side isometric partially transparent view of a single two-spar panhard roll-attenuation embodiment of the present invention, shown in the at-rest position.
Figure 38:
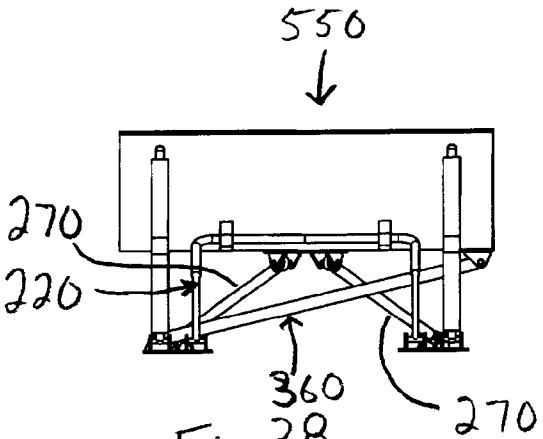
FIG. 38 is a forward elevation view of the embodiment illustrated in FIG. 36, shown in the at-rest position.

Referring to FIGS. 28 through 35, there is illustrated an embodiment of the present invention comprising a marine platform 200 and an associated double two-spar roll-attenuation suspension system, generally referenced by numeral 500, mounted to a deck 204. In FIGS. 28 through 31, the embodiment is shown with the marine platform 200 in a no-load at-rest position. In FIGS. 32 and 33, the embodiment is shown with the marine platform 200 in a compressed bottom position. In FIGS. 34 and 35, the embodiment is shown with the marine platform 200 rolled to starboard relative to the deck 204.

In the embodiment shown in FIGS. 28 through 35, the double two-spar roll-attenuation suspension system 500, includes four struts 206, a roll-attenuation assembly 220 and four spars 270. The spars 270 are arranged in two pairs, a forward pair and an aft pair, with each pair in the shape of a V, with the base of the V attached to the marine platform 200 and the top of the V attached to the deck 204.

Figure 40:
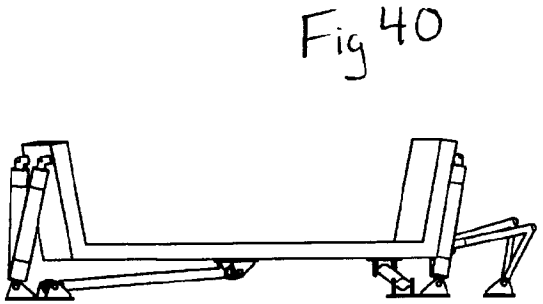
FIG. 40 is a starboard-side elevation view of the embodiment illustrated in FIG. 36, shown in a compressed position.
Figure 37:
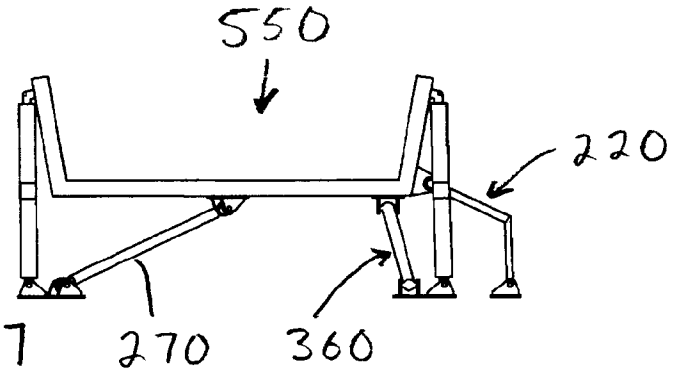
FIG. 37 is a starboard-side elevation view of the embodiment illustrated in FIG. 36, shown in the at-rest position.
Figure 39:
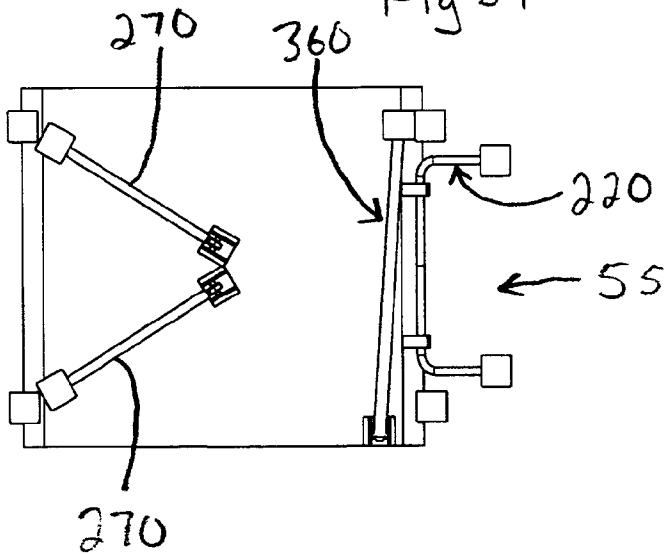
FIG. 39 is a bottom plan view of the embodiment illustrated in FIG. 36, shown in the at-rest position.
Figure 41:
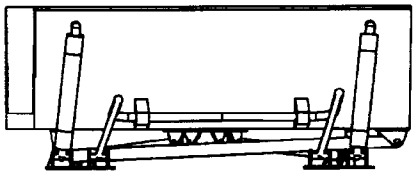
FIG. 41 is a forward elevation view of the embodiment illustrated in FIG. 36, shown in a compressed position.
Figure 44:
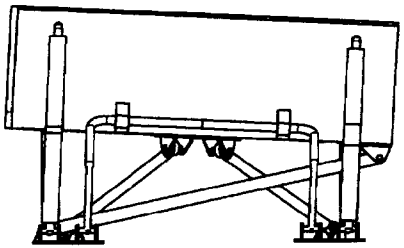
FIG. 44 is a forward elevation view of the embodiment illustrated in FIG. 36, shown in a rolled-to-starboard position.
Figure 42:
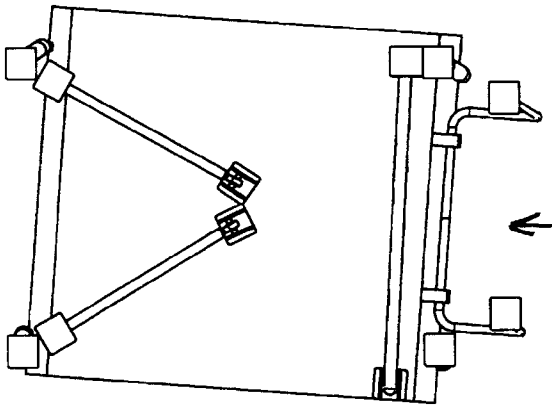
FIG. 42 is a bottom plan view of the embodiment illustrated in FIG. 36, shown in a compressed position.
Figure 43:
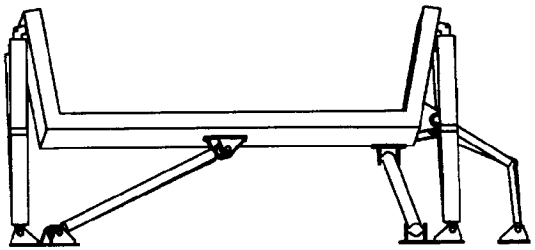
FIG. 43 is a starboard-side elevation view of the embodiment illustrated in FIG. 36, shown in a rolled-to-starboard position.
Figure 45:
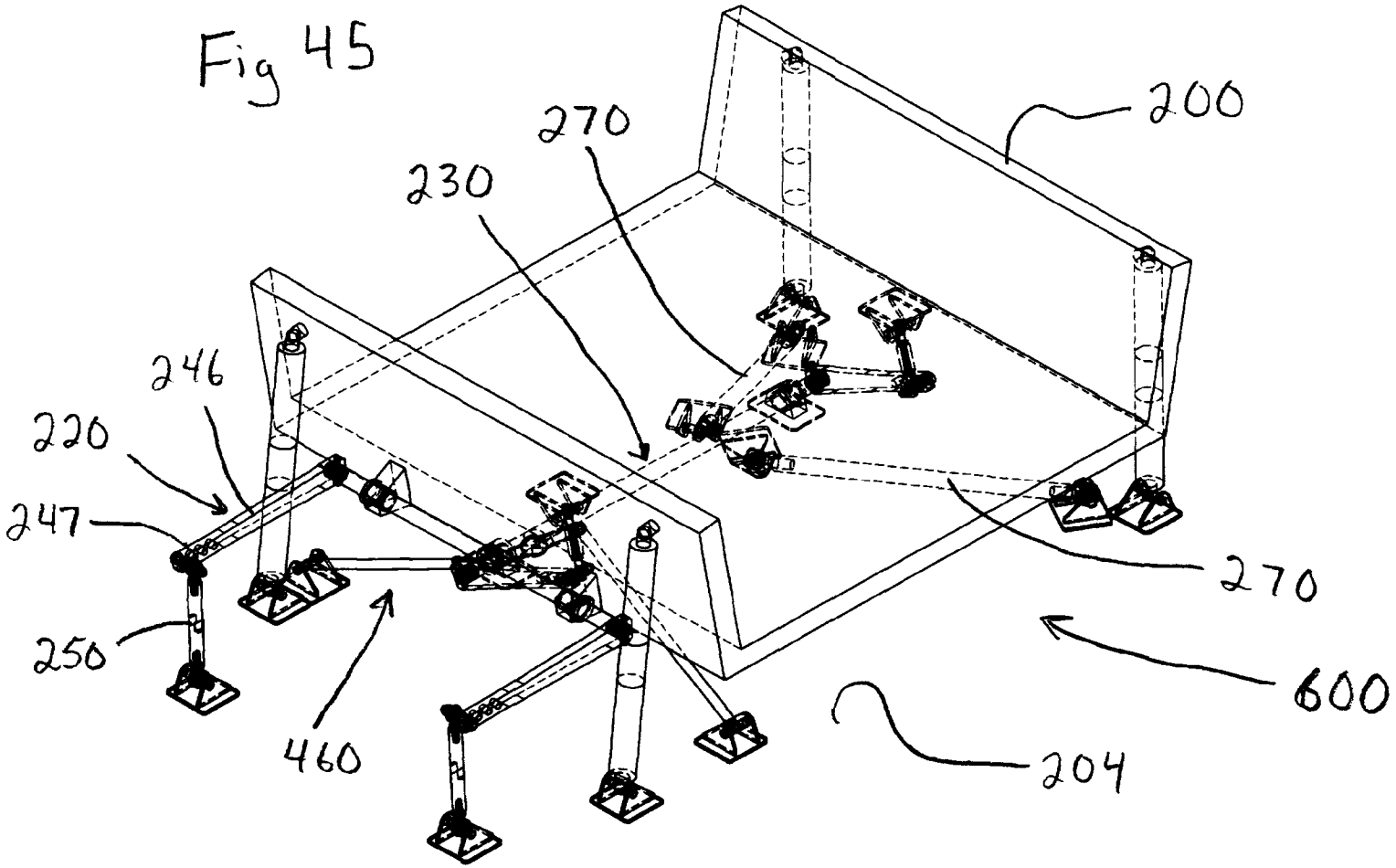
FIG. 45 is a forward-port-side isometric partially transparent view of a single two-spar Watt's linkage roll-attenuation pitch-attenuation embodiment of the present invention, shown in the at-rest position.
Figure 47:
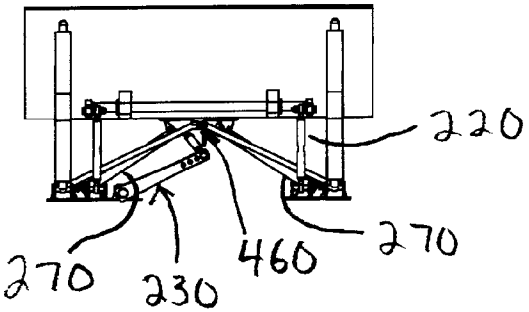
FIG. 47 is a forward elevation view of the embodiment illustrated in FIG. 45, shown in the at-rest position.

Referring to FIGS. 36 through 44, there is illustrated an embodiment of the present invention comprising a marine platform 200 and an associated single two-spar panhard roll-attenuation suspension system, generally referenced by numeral 550, mounted to a deck 204. In FIGS. 36 through 39, the embodiment is shown with the marine platform 200 in a no-load at-rest position. In FIGS. 40 through 42, the embodiment is shown with the marine platform 200 in a compressed bottom position. In FIGS. 43 and 44, the embodiment is shown with the marine platform 200 rolled to port relative to the deck 204.

In the embodiment shown in FIGS. 36 through 44, the single two-spar panhard roll-attenuation suspension system 550, includes four struts 206, a roll-attenuation assembly 220, a panhard assembly 360 and two spars 270. The spars 270 are arranged as a single aft pair, with the pair in the shape of a V, with the base of the V attached to the marine platform 200 and the top of the V attached to the deck 204.

Figure 49:
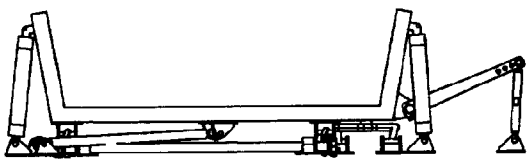
FIG. 49 is a starboard-side elevation view of the embodiment illustrated in FIG. 45, shown in a compressed position.
Figure 46:
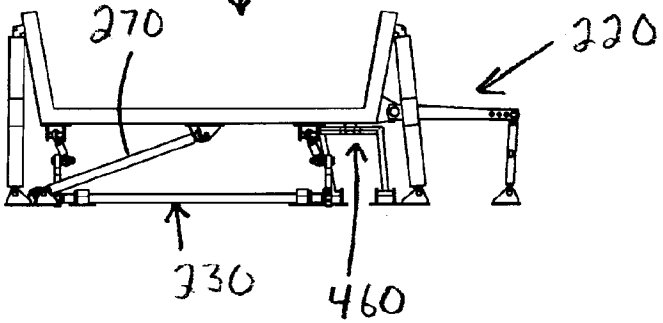
FIG. 46 is a starboard-side elevation view of the embodiment illustrated in FIG. 45, shown in the at-rest position.
Figure 48:
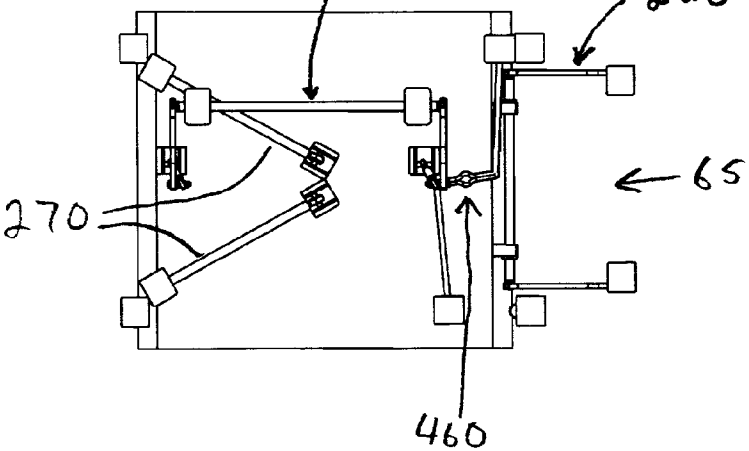
FIG. 48 is a bottom plan view of the embodiment illustrated in FIG. 45, shown in the at-rest position.
Figure 50:
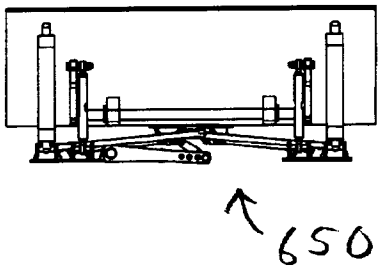
FIG. 50 is a forward elevation view of the embodiment illustrated in FIG. 45, shown in a compressed position.
Figure 53:
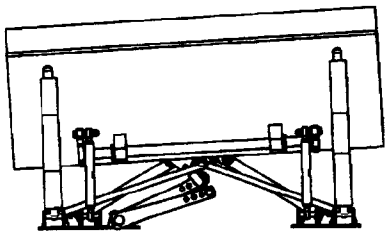
FIG. 53 is a forward elevation view of the embodiment illustrated in FIG. 45, shown in a rolled-to-starboard position.
Figure 51:
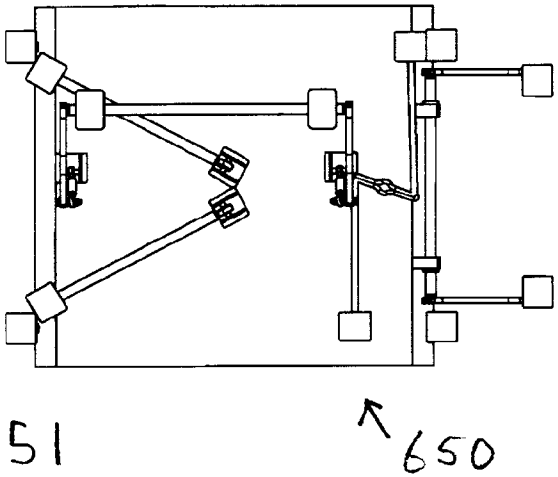
FIG. 51 is a bottom plan view of the embodiment illustrated in FIG. 45, shown in a compressed position.
Figure 52:
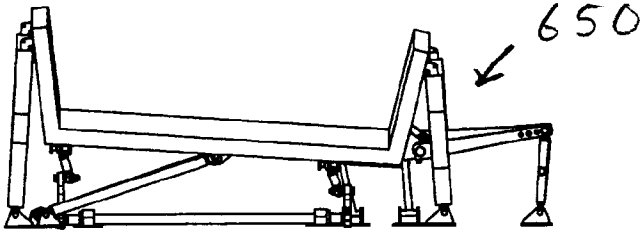
FIG. 52 is a starboard-side elevation view of the embodiment illustrated in FIG. 45, shown in a rolled-to-starboard position.

Referring to FIGS. 45 through 53, there is illustrated an embodiment of the present invention comprising a marine platform 200 and an associated single two-spar Watt's linkage roll-attenuation pitch-attenuation suspension system, generally referenced by numeral 600, mounted to a deck 204. In FIGS. 45 through 48, the embodiment is shown with the marine platform 200 in a no-load at-rest position. In FIGS. 49 through 51, the embodiment is shown with the marine platform 200 in a compressed bottom position. In FIGS. 52 and 53, the embodiment is shown with the marine platform 200 rolled to starboard relative to the deck 204.

In the embodiment shown in FIGS. 45 through 53, the single two-spar Watt's linkage roll-attenuation pitch-attenuation suspension system 600, includes four struts 206, a roll-attenuation assembly 220, a pitch-attenuation assembly 230, a Watt's linkage 460 and two spars 270. The spars 270 are arranged as a single aft pair, with the pair in the shape of a V, with the base of the V attached to the marine platform 200 and the top of the V attached to the deck 204.

Figure 54:
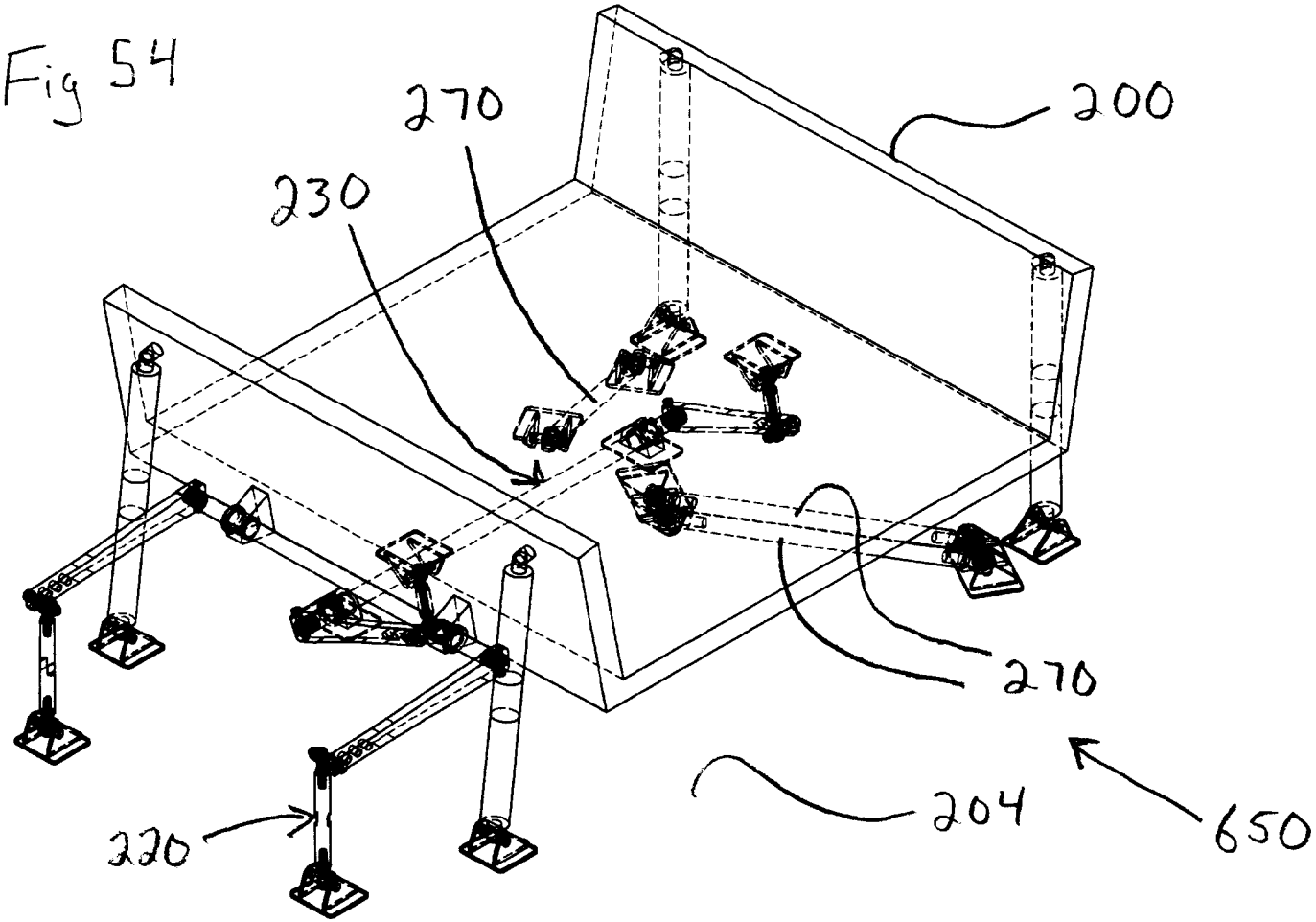
FIG. 54 is a forward-port-side isometric partially transparent view of a single one-spar-two-spar roll-attenuation pitch-attenuation embodiment of the present invention, shown in the at-rest position.
Figures 55, 56, 57, 58, 59, 60:
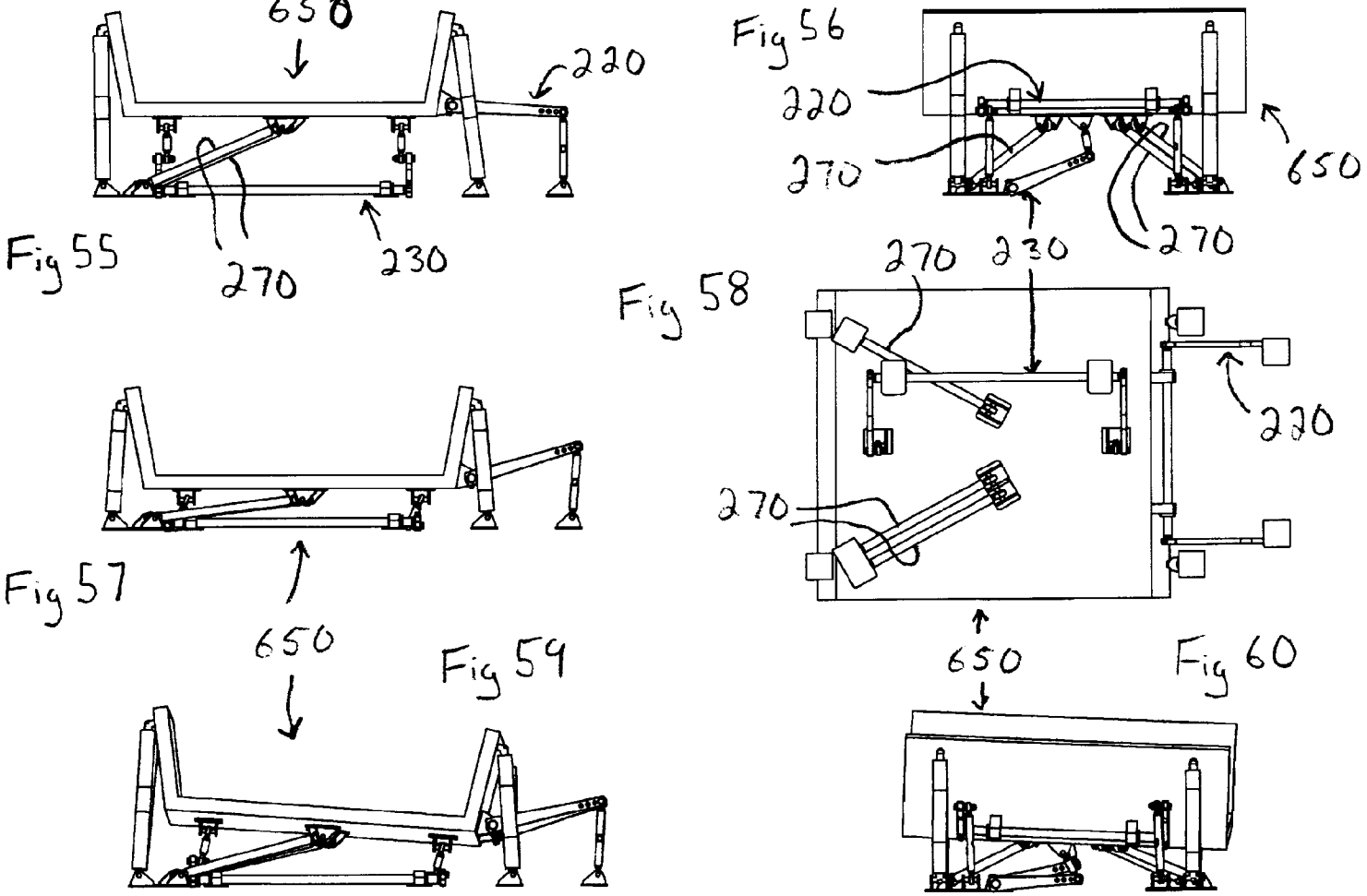
FIG. 55 is a starboard-side elevation view of the embodiment illustrated in FIG. 54, shown in the at-rest position.
FIG. 56 is a forward elevation view of the embodiment illustrated in FIG. 54, shown in the at-rest position.
FIG. 57 is a starboard-side elevation view of the embodiment illustrated in FIG. 54, shown in a compressed position.
FIG. 58 is a bottom plan view of the embodiment illustrated in FIG. 54, shown in a compressed position.
FIG. 59 is a starboard-side elevation view of the embodiment illustrated in FIG. 54, shown in a rolled-to-port position.
FIG. 60 is a forward elevation view of the embodiment illustrated in FIG. 54, shown in a rolled-to-port position.

Referring to FIGS. 54 through 60, there is illustrated an embodiment of the present invention comprising a marine platform 200 and an associated single one-spar-two-spar roll-attenuation pitch-attenuation suspension system, generally referenced by numeral 650, mounted to a deck 204. In FIGS. 54 through 56, the embodiment is shown with the marine platform 200 in a no-load at-rest position. In FIGS. 57 and 58, the embodiment is shown with the marine platform 200 in a compressed position. In FIGS. 59 and 60, the embodiment is shown with the marine platform 200 rolled to port and with forward-end-down pitch, both relative to the deck 204.

In the embodiment shown in FIGS. 54 through 60, the single one-spar-two-spar roll-attenuation pitch-attenuation suspension system 650, includes four struts 206, a roll-attenuation assembly 220, a pitch-attenuation assembly 230, and three spars 270. The three spars 270 are arranged in the shape of a V, with two of the spars 270 adjacent and parallel to each other, and defining one side of the V, and the third spar 270 defining the other side of the V; and with the base of the V attached to the marine platform 200 and the top of the V attached to the deck 204.

Figure 61:
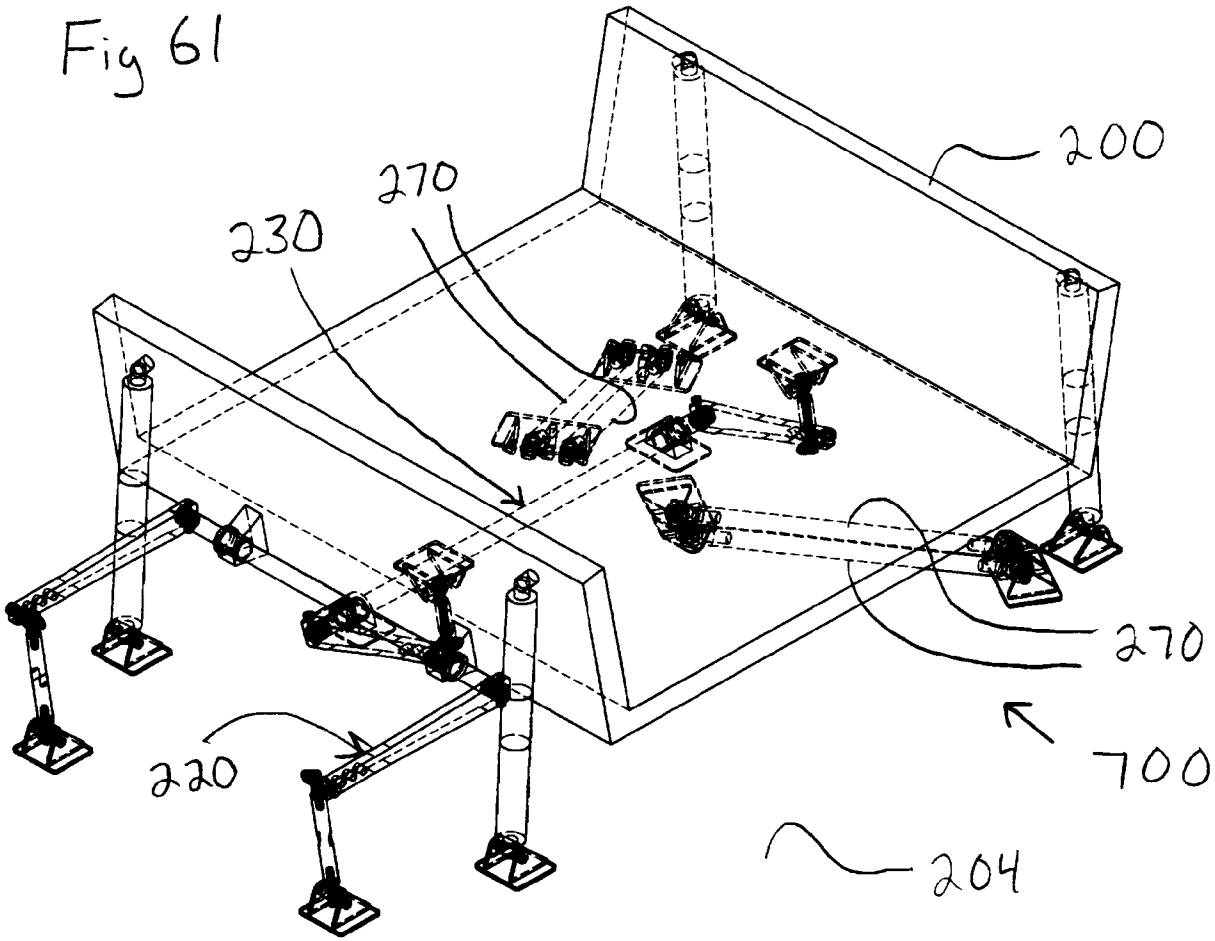
FIG. 61 is a forward-port-side isometric partially transparent view of a single two-spar-two-spar roll-attenuation pitch-attenuation embodiment of the present invention, shown in the at-rest position.
Figure 63:
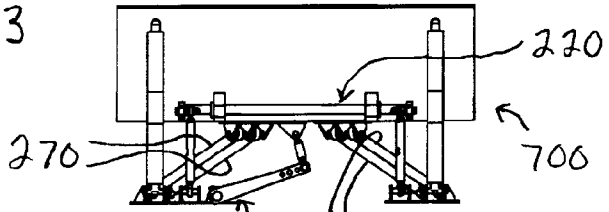
FIG. 63 is a forward elevation view of the embodiment illustrated in FIG. 61, shown in the at-rest position.
Figure 65:
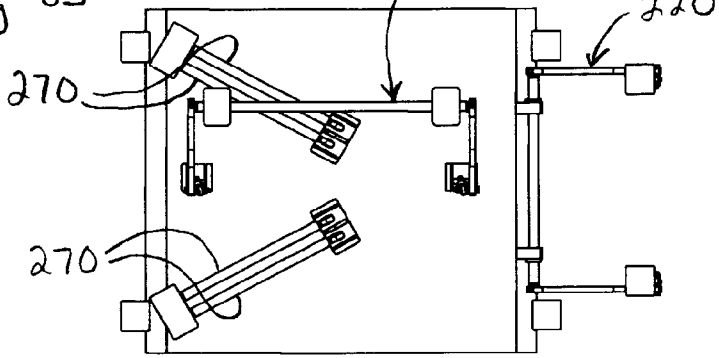
FIG. 65 is a bottom plan view of the embodiment illustrated in FIG. 61, shown in a compressed position.
Figure 67:
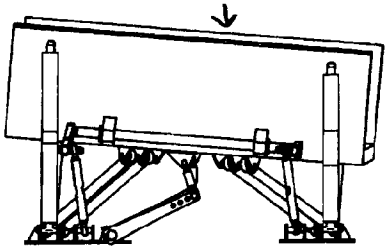
FIG. 67 is a forward elevation view of the embodiment illustrated in FIG. 61, shown in a rolled-to-port position.
Figure 62:
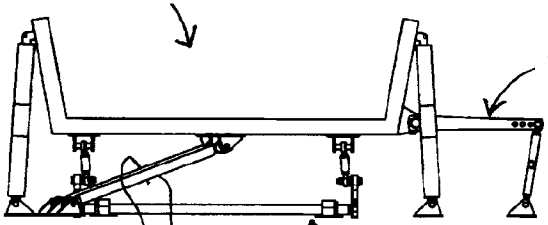
FIG. 62 is a starboard-side elevation view of the embodiment illustrated in FIG. 61, shown in the at-rest position.
Figure 64:
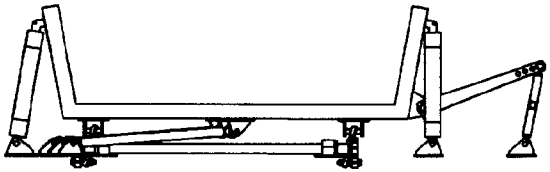
FIG. 64 is a starboard-side elevation view of the embodiment illustrated in FIG. 61, shown in a compressed position.
Figure 66:
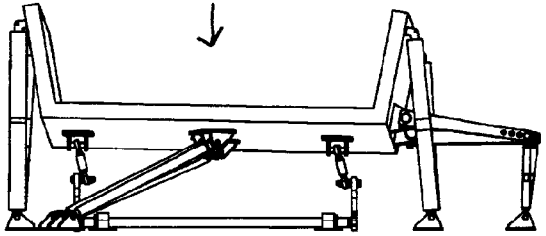
FIG. 66 is a starboard-side elevation view of the embodiment illustrated in FIG. 61, shown in a rolled-to-port position.

Referring to FIGS. 61 through 67, there is illustrated an embodiment of the present invention comprising a marine platform 200 and an associated single two-spar-two-spar roll-attenuation pitch-attenuation suspension system, generally referenced by numeral 700, mounted to a deck 204. In FIGS. 61 through 63, the embodiment is shown with the marine platform 200 in a no-load at-rest position. In FIGS. 64 and 65, the embodiment is shown with the marine platform 200 in a compressed position. In FIGS. 66 and 67, the embodiment is shown with the marine platform 200 rolled to port relative to the deck 204.

In the embodiment shown in FIGS. 61 through 67, the single two-spar-two-spar roll-attenuation pitch-attenuation suspension system 700, includes four struts 206, a roll-attenuation assembly 220, a pitch-attenuation assembly 230, and four spars 270. The four spars 270 are arranged in the shape of a V, with two of the spars 270 adjacent and parallel to each other, and defining one side of the V, and the other two of the spars 270 adjacent and parallel to each other, and defining the other side of the V; and with the base of the V attached to the marine platform 200 and the top of the V attached to the deck 204.

Figure 68:
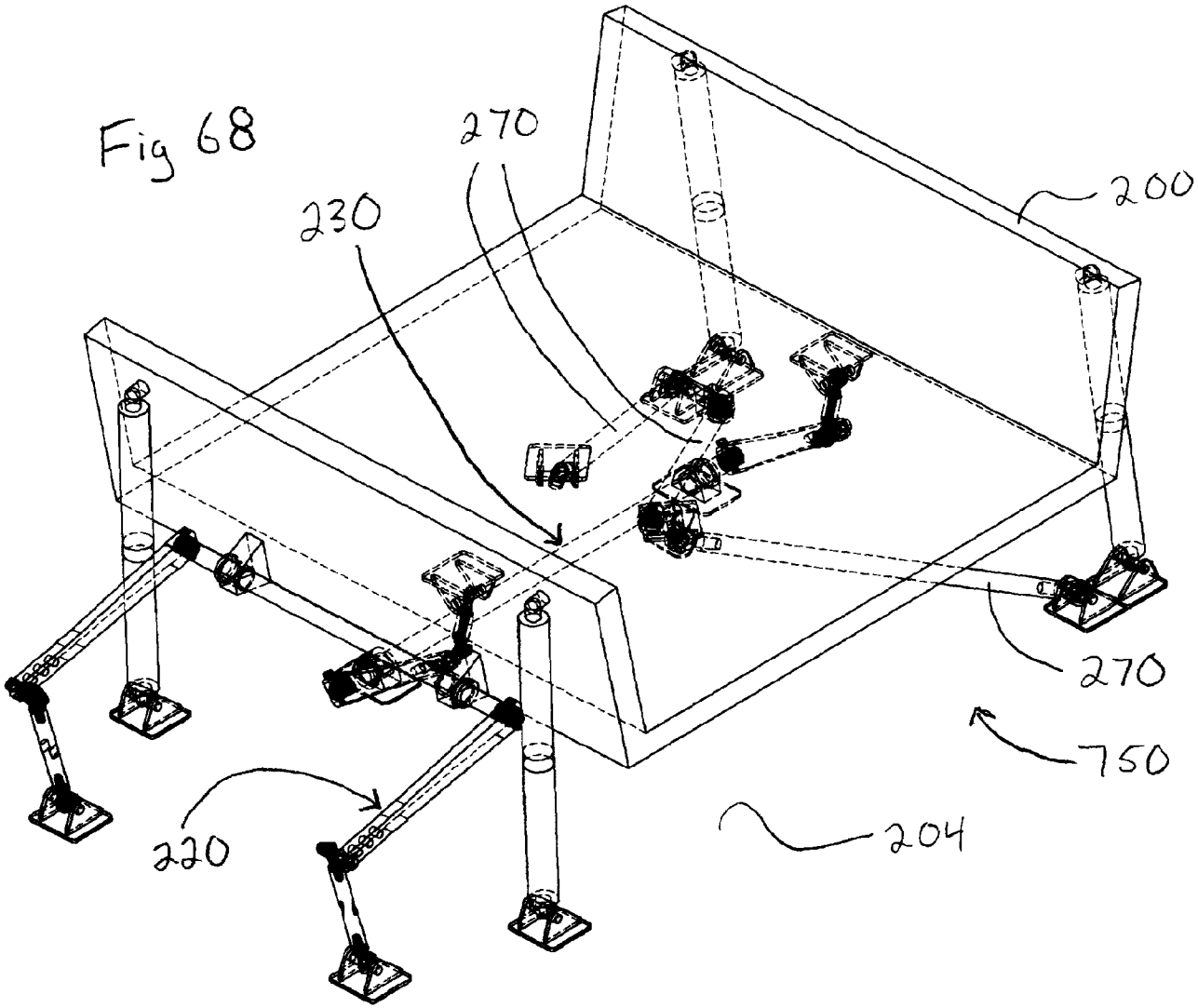
FIG. 68 is a forward-port-side isometric partially transparent view of a single three-spar anti-sway anti-pitch clevis-mount embodiment of the present invention, shown in the at-rest position.
Figures 69, 70, 71, 72, 73, 74:
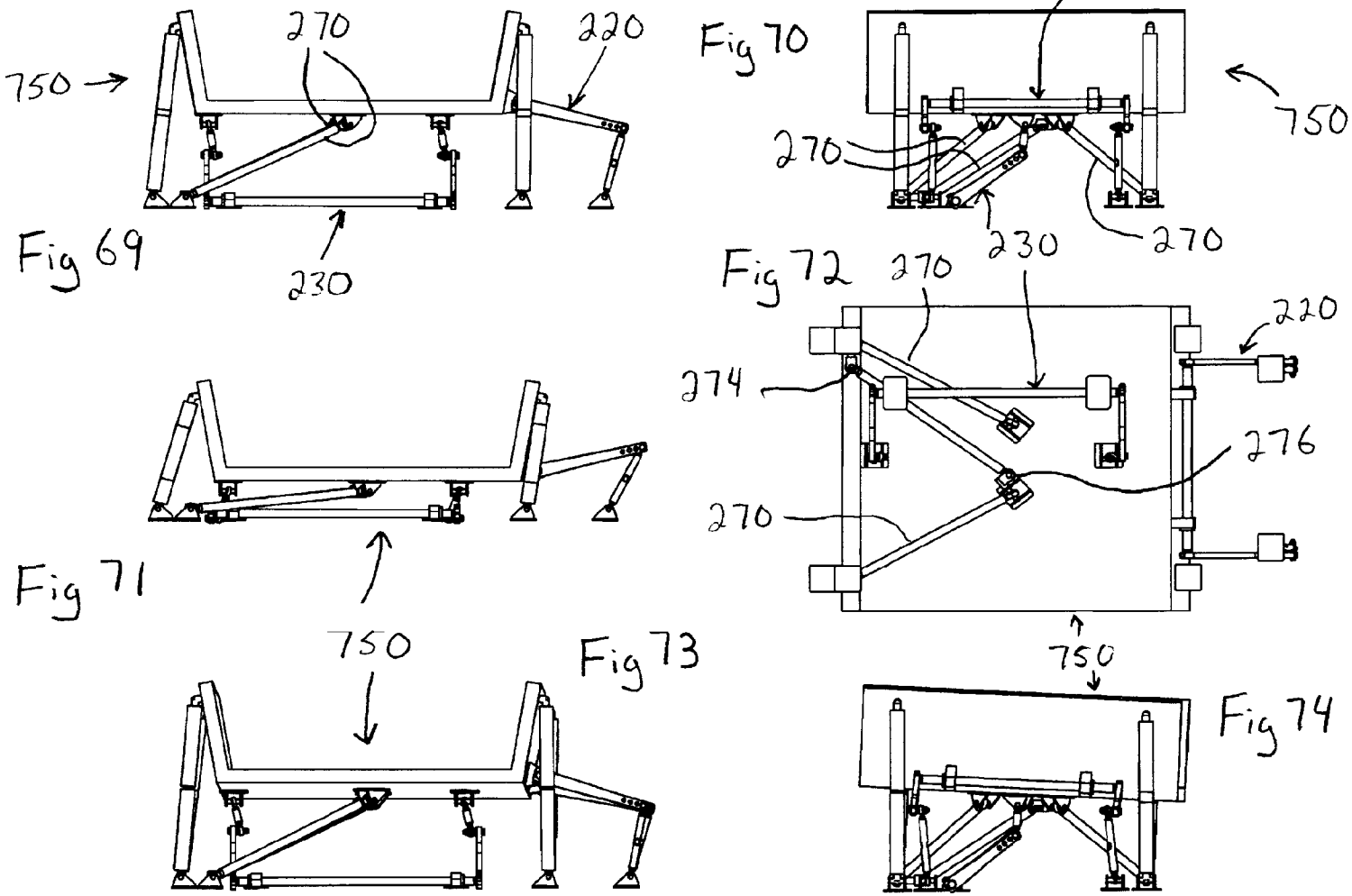
FIG. 69 is a starboard-side elevation view of the embodiment illustrated in FIG. 68, shown in the at-rest position.
FIG. 70 is a forward elevation view of the embodiment illustrated in FIG. 68, shown in the at-rest position.
FIG. 71 is a starboard-side elevation view of the embodiment illustrated in FIG. 68, shown in a compressed position.
FIG. 72 is a bottom plan view of the embodiment illustrated in FIG. 68, shown in a compressed position.
FIG. 73 is a starboard-side elevation view of the embodiment illustrated in FIG. 68, shown in a rolled-to-port position.
FIG. 74 is a forward elevation view of the embodiment illustrated in FIG. 68, shown in a rolled-to-port position.

Referring to FIGS. 68 through 74, there is illustrated an embodiment of the present invention comprising a marine platform 200 and an associated single three-spar-splayed roll-attenuation pitch-attenuation clevis-mount suspension system, generally referenced by numeral 750, mounted to a deck 204. In FIGS. 68 through 70, the embodiment is shown with the marine platform 200 in a no-load at-rest position. In FIGS. 71 and 72, the embodiment is shown with the marine platform 200 in a compressed position. In FIGS. 73 and 74, the embodiment is shown with the marine platform 200 rolled to port relative to the deck 204.

In the embodiment shown in FIGS. 68 through 74, the single three-spar-splayed roll-attenuation pitch-attenuation clevis-mount suspension system 750, includes four struts 206, a roll-attenuation assembly 220, a pitch-attenuation assembly 230, and three spars 270. The three spars 270 are generally splayed in that the spars 270 diverge in that the ends of the spars 270 mounted to the marine platform are closer one to the other than the ends of the spars 270 mounted to the deck 204.

As indicated most clearly in FIG. 72, in the single three-spar-splayed roll-attenuation pitch-attenuation clevis-mount suspension system 750, the middle spar 270 and starboard-side spar 270 are mounted to the deck 204 with a spar clevis bracket 274; and the middle spar 270 and port-side spar 270 are mounted to the marine platform 200 with a spar clevis lateral bracket 276.

Figure 75:
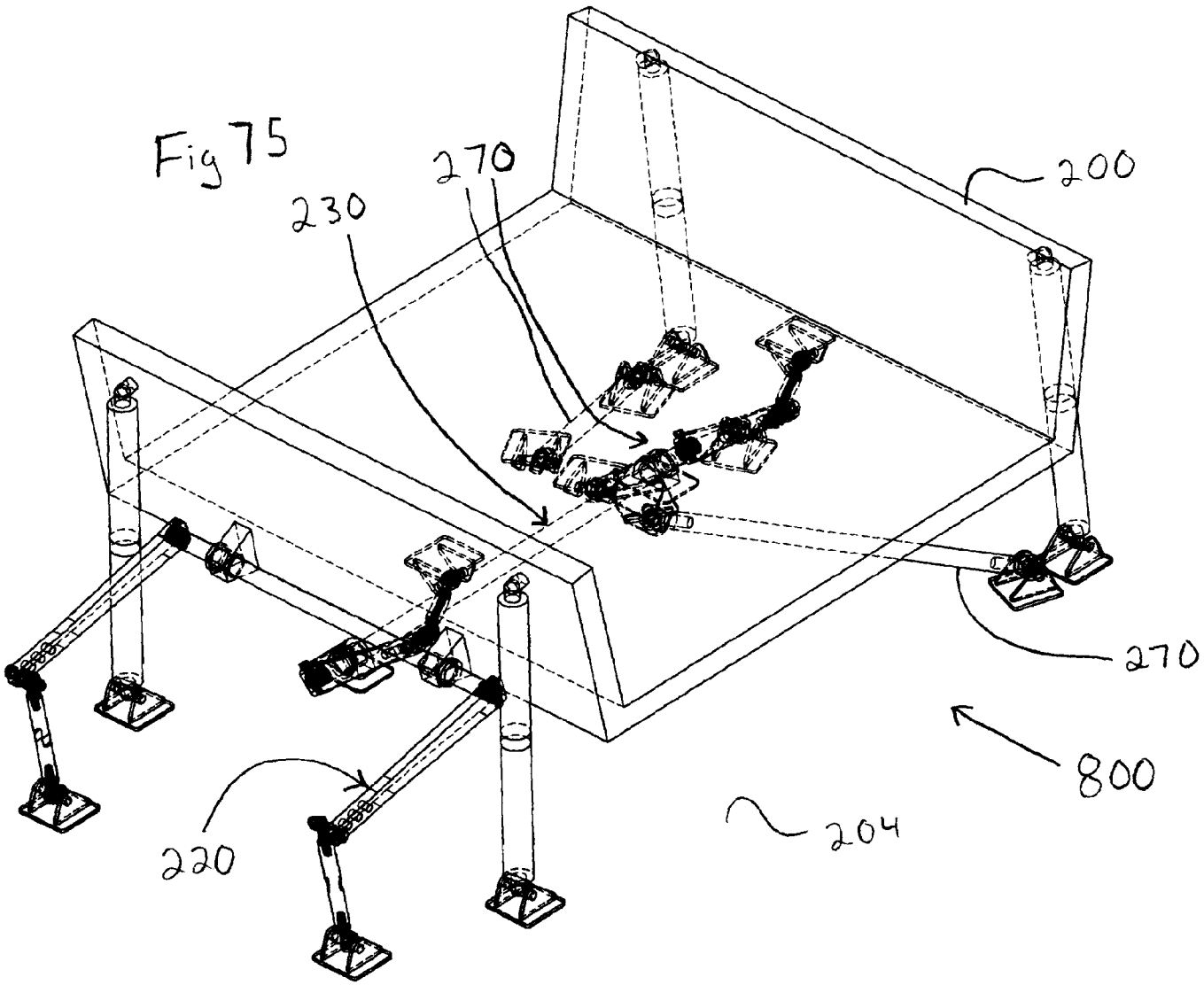
FIG. 75 is a forward-port-side isometric partially transparent view of a single three-spar roll-attenuation pitch-attenuation embodiment of the present invention, shown in the at-rest position.
Figures 76, 77, 78, 79, 80, 81:
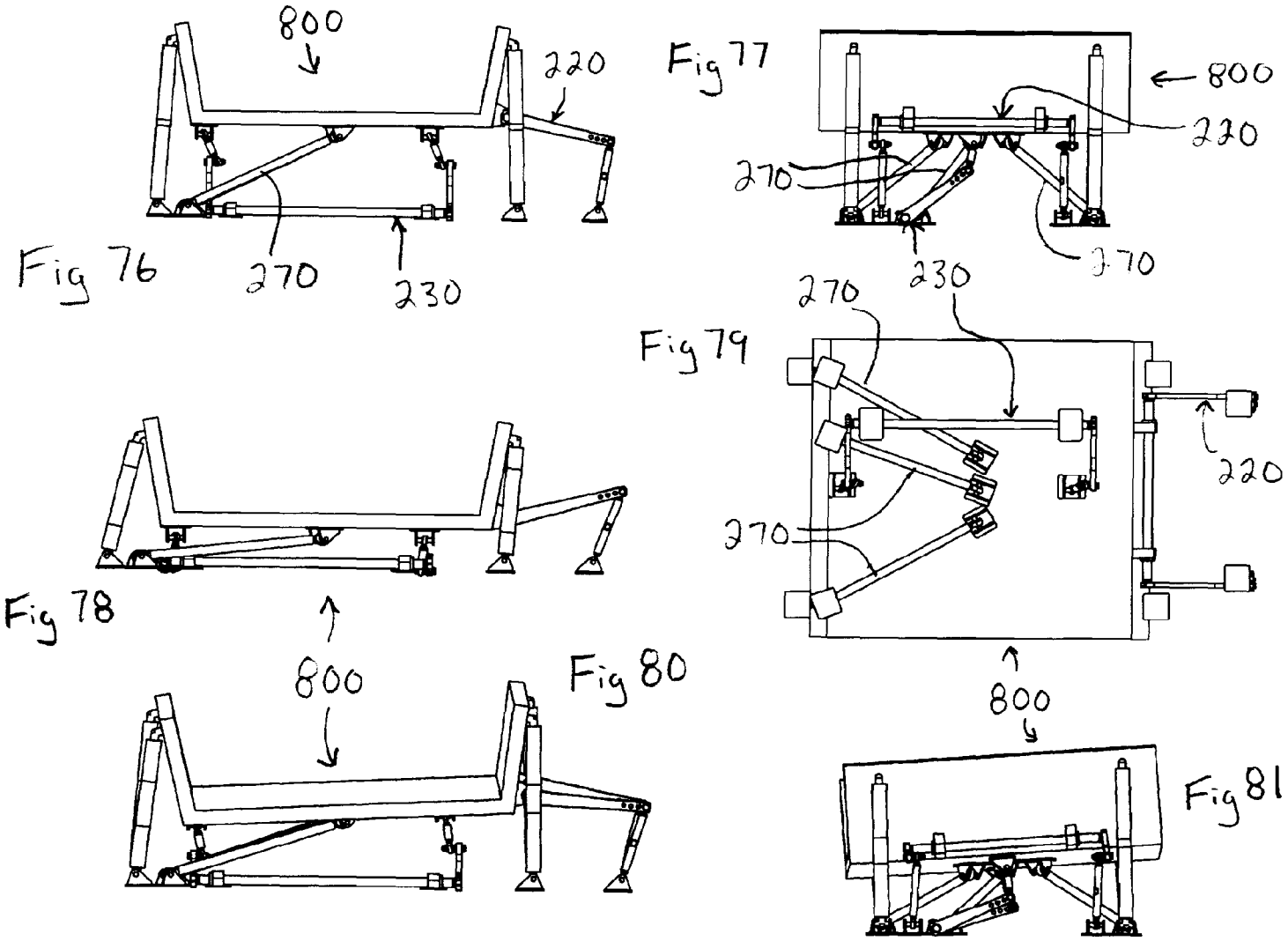
FIG. 76 is a starboard-side elevation view of the embodiment illustrated in FIG. 75, shown in the at-rest position.
FIG. 77 is a forward elevation view of the embodiment illustrated in FIG. 75, shown in the at-rest position.
FIG. 78 is a starboard-side elevation view of the embodiment illustrated in FIG. 75, shown in a compressed position.
FIG. 79 is a bottom plan view of the embodiment illustrated in FIG. 75, shown in a compressed position.
FIG. 80 is a starboard-side elevation view of the embodiment illustrated in FIG. 75, shown in a rolled-to-starboard position.
FIG. 81 is a forward elevation view of the embodiment illustrated in FIG. 75, shown in a rolled-to-starboard position.

Referring to FIGS. 75 through 81, there is illustrated an embodiment of the present invention comprising a marine platform 200 and an associated single three-spar-splayed roll-attenuation pitch-attenuation suspension system, generally referenced by numeral 800, mounted to a deck 204. In FIGS. 75 through 77, the embodiment is shown with the marine platform 200 in a no-load at-rest position. In FIGS. 78 and 79, the embodiment is shown with the marine platform 200 in a compressed position. In FIGS. 80 and 81, the embodiment is shown with the marine platform 200 rolled to starboard relative to the deck 204.

In the embodiment shown in FIGS. 75 through 81, the single three-spar-splayed roll-attenuation pitch-attenuation suspension system 800, includes four struts 206, a roll-attenuation assembly 220, a pitch-attenuation assembly 230, and three spars 270. The three spars 270 are generally splayed in that the spars 270 diverge in that the ends of the spars 270 mounted to the marine platform are closer one to the other than the ends of the spars 270 mounted to the deck 204.

Figure 82:
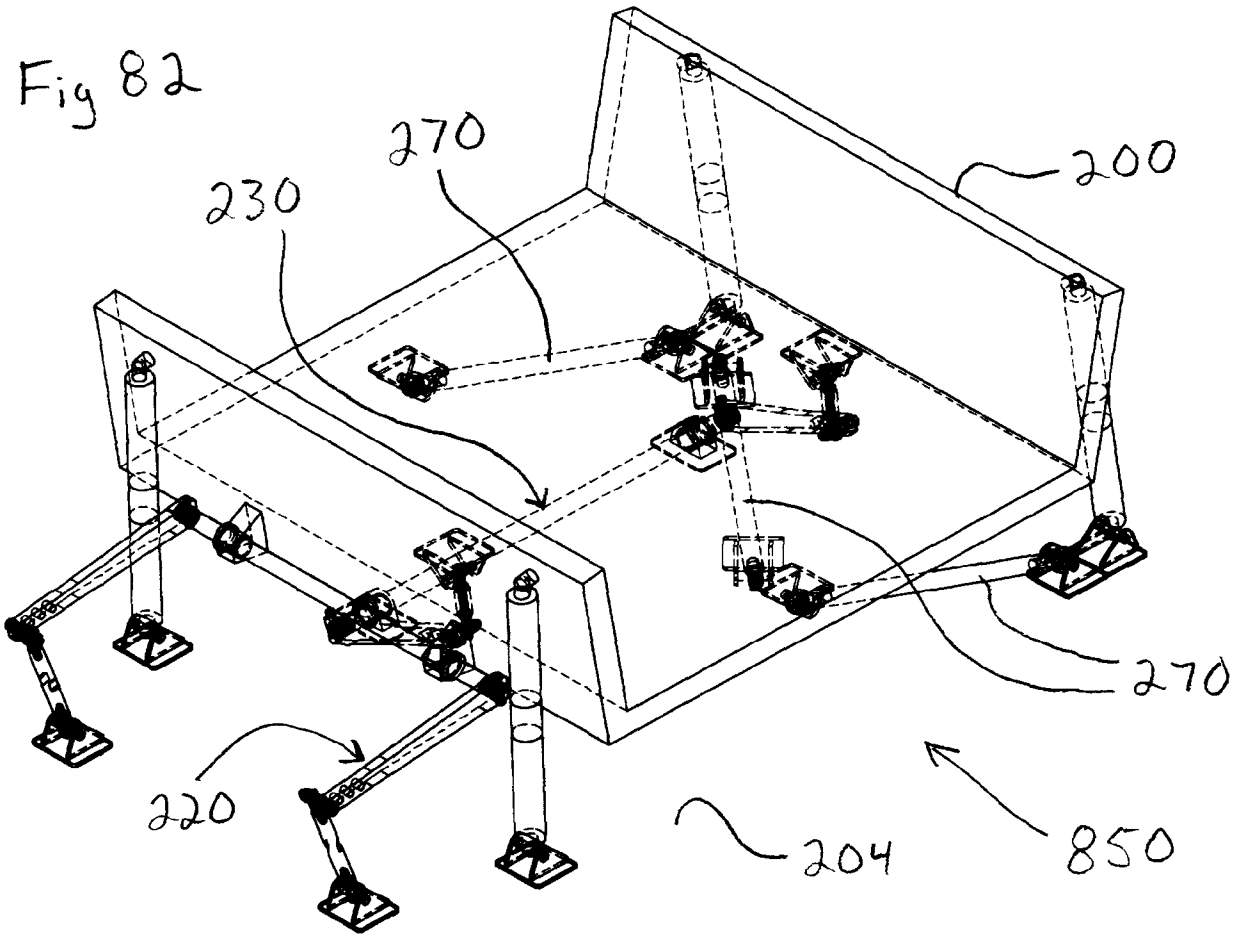
FIG. 82 is a forward-port-side isometric partially transparent view of a single three-spar Z-style roll-attenuation pitch-attenuation embodiment of the present invention, shown in the at-rest position.
Figures 83, 84, 85, 86, 87, 88:
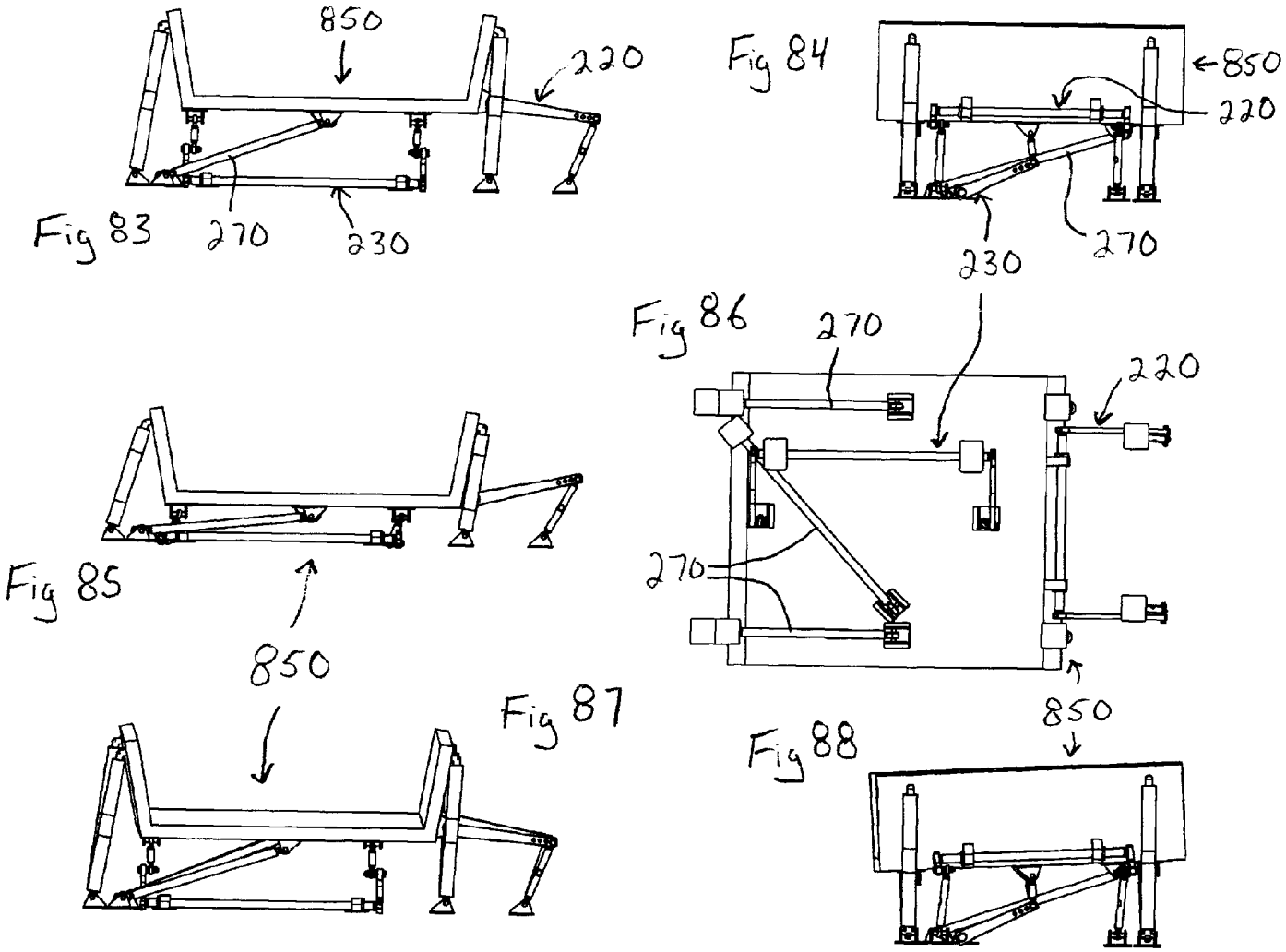
FIG. 83 is a starboard-side elevation view of the embodiment illustrated in FIG. 82, shown in the at-rest position.
FIG. 84 is a forward elevation view of the embodiment illustrated in FIG. 82, shown in the at-rest position.
FIG. 85 is a starboard-side elevation view of the embodiment illustrated in FIG. 82, shown in a compressed position.
FIG. 86 is a bottom plan view of the embodiment illustrated in FIG. 82, shown in a compressed position.
FIG. 87 is a starboard-side elevation view of the embodiment illustrated in FIG. 82, shown in a rolled-to-starboard position.
FIG. 88 is a forward elevation view of the embodiment illustrated in FIG. 82, shown in a rolled-to-starboard position.

Referring to FIGS. 82 through 88, there is illustrated an embodiment of the present invention comprising a marine platform 200 and an associated single three-spar Z-style roll-attenuation pitch-attenuation suspension system, generally referenced by numeral 850, mounted to a deck 204. In FIGS. 82 through 84, the embodiment is shown with the marine platform 200 in a no-load at-rest position. In FIGS. 85 and 86, the embodiment is shown with the marine platform 200 in a compressed position. In FIGS. 87 and 88, the embodiment is shown with the marine platform 200 rolled to starboard relative to the deck 204.

In the embodiment shown in FIGS. 82 through 88, the single three-spar Z-style roll-attenuation pitch-attenuation suspension system 850, includes four struts 206, a roll-attenuation assembly 220, a pitch-attenuation assembly 230, and three spars 270. The three spars 270 are generally arranged in the form of a Z, in that the two outer spars 270 (i.e., the spar 270 that is furthest starboard and the spar 270 that is furthest port) are essentially parallel one to the other, and the middle spar 270 extends essentially diagonally between them, extending from the vicinity of the end of the starboard-side spar 270 mounted to the deck 204 to the vicinity of the end of the port-side spar 270 mounted to the marine platform 200.

Figure 89:
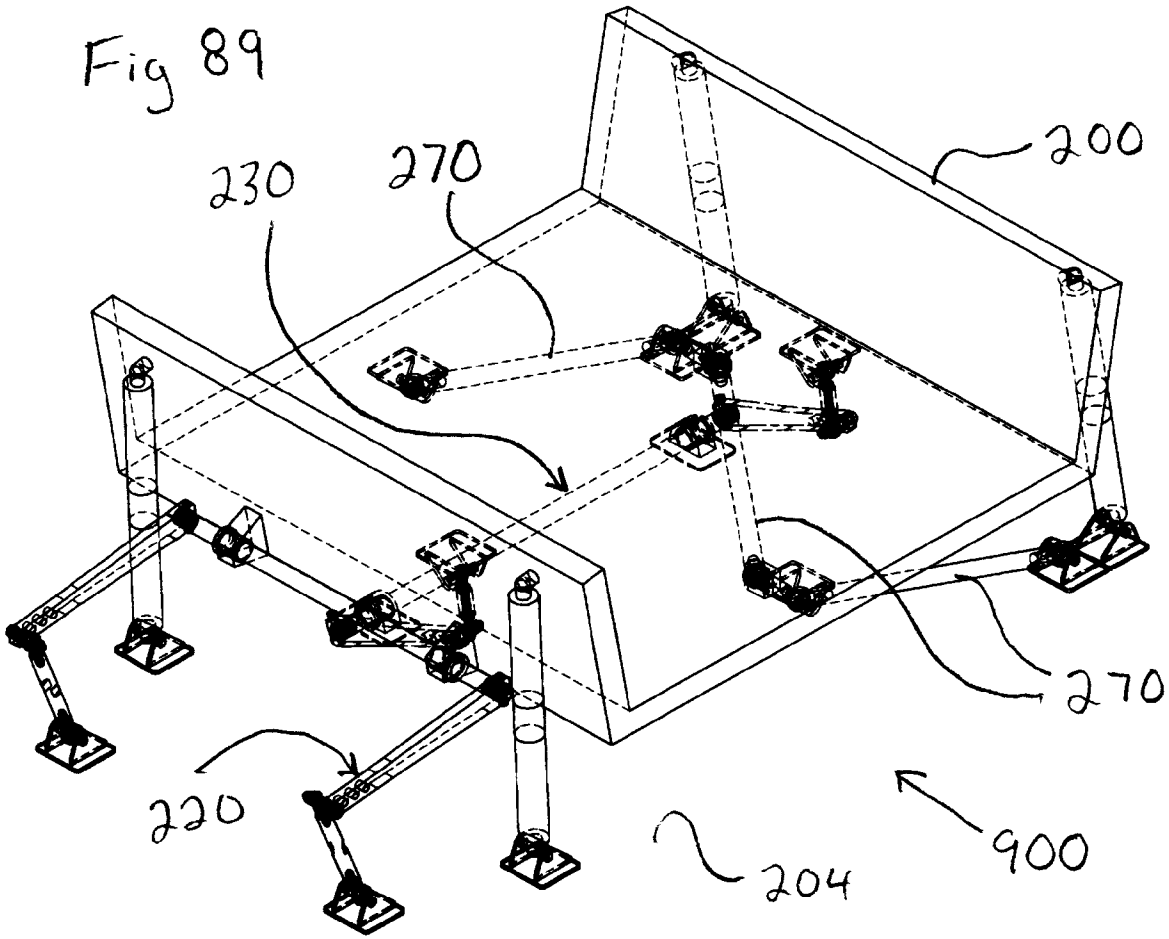
FIG. 89 is a forward-port-side isometric partially transparent view of a single three-spar Z-style roll-attenuation pitch-attenuation clevis-mount embodiment of the present invention, shown in the at-rest position.
Figures 90, 91, 92, 93, 94, 95:
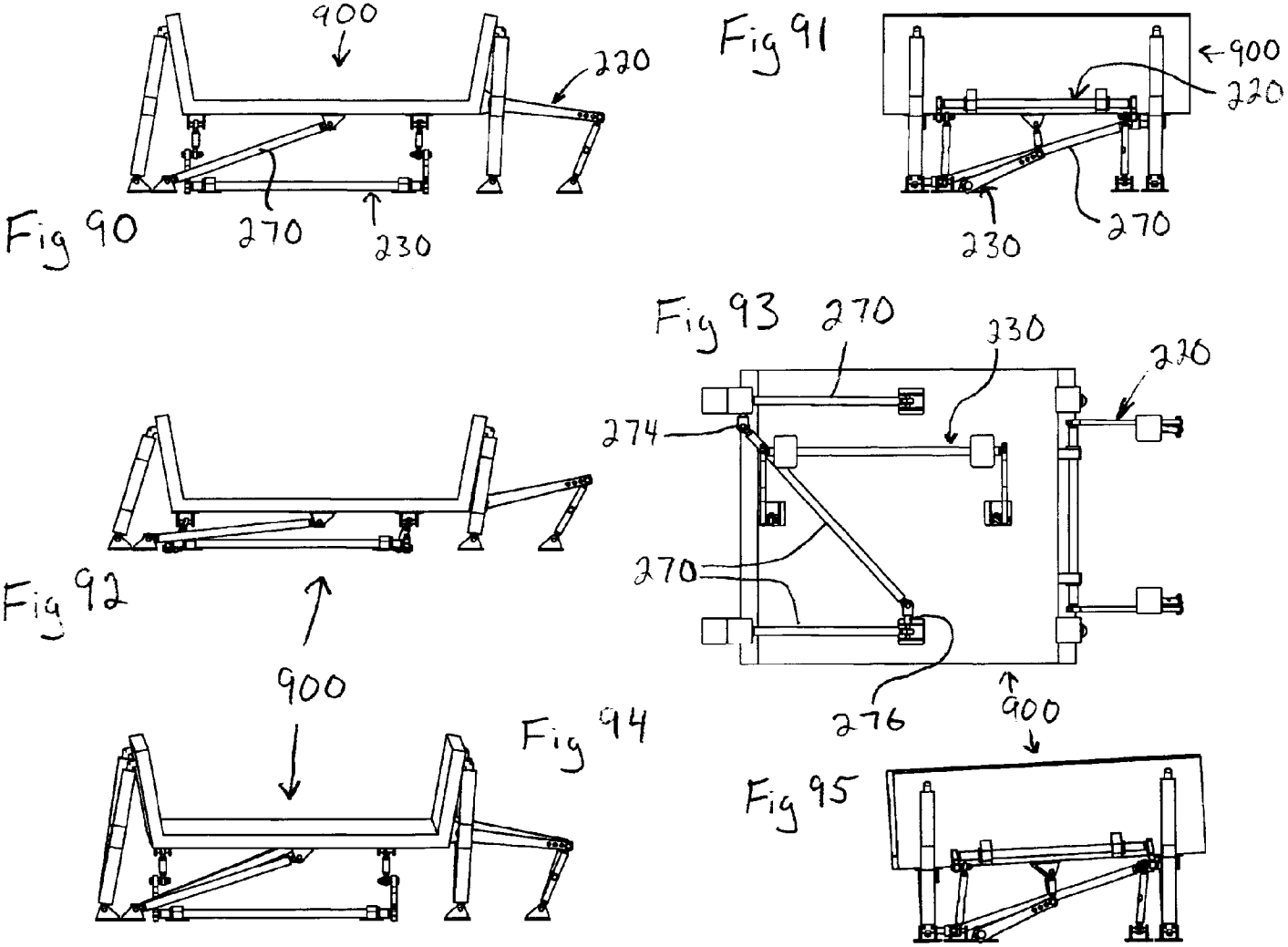
FIG. 90 is a starboard-side elevation view of the embodiment illustrated in FIG. 89, shown in the at-rest position.
FIG. 91 is a forward elevation view of the embodiment illustrated in FIG. 89, shown in the at-rest position.
FIG. 92 is a starboard-side elevation view of the embodiment illustrated in FIG. 89, shown in a compressed position.
FIG. 93 is a bottom plan view of the embodiment illustrated in FIG. 89, shown in a compressed position.
FIG. 94 is a starboard-side elevation view of the embodiment illustrated in FIG. 89, shown in a rolled-to-starboard position.
FIG. 95 is a forward elevation view of the embodiment illustrated in FIG. 89, shown in a rolled-to-starboard position.
Figure 96:
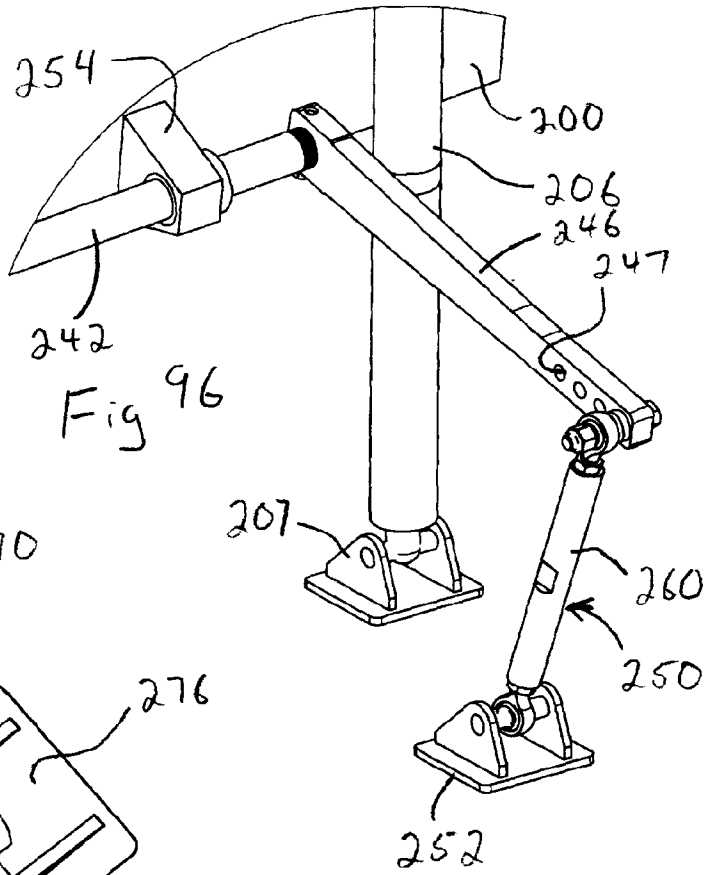
FIG. 96 is an isometric isolation view of a portion of an anti-sway assembly embodiment of the present invention.
Figure 97:
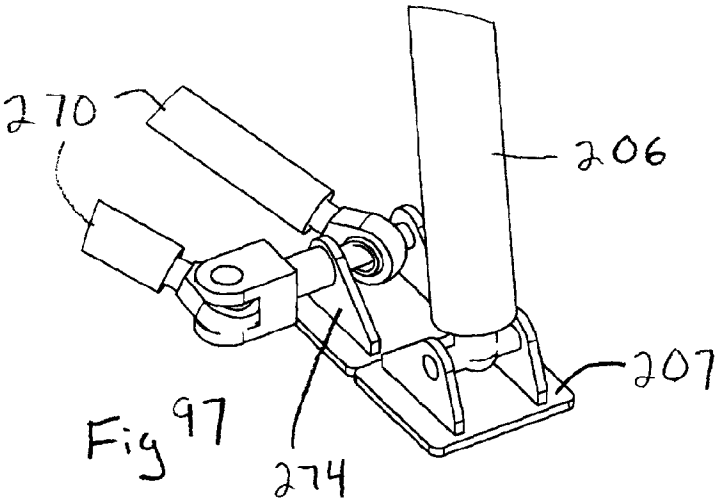
FIG. 97 is an isometric isolation view of an in-line clevis mount embodiment of the present invention.
Figure 98:
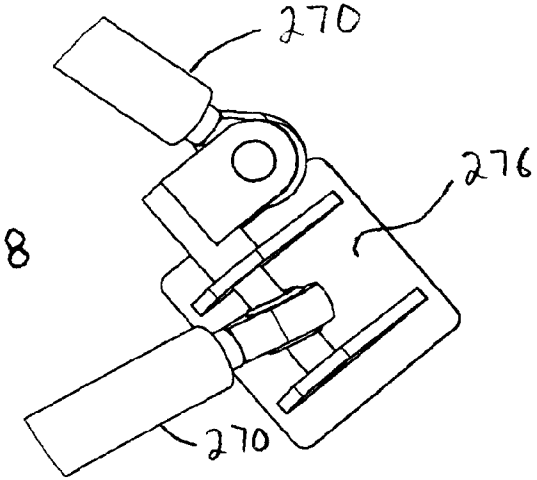
FIG. 98 is a bottom plan view of laterally displaced clevis mount embodiment of the present invention.

Referring to FIGS. 89 through 95, there is illustrated an embodiment of the present invention comprising a marine platform 200 and an associated single three-spar Z-style roll-attenuation pitch-attenuation clevis-mount suspension system, generally referenced by numeral 900, mounted to a deck 204. In FIGS. 89 through 91, the embodiment is shown with the marine platform 200 in a no-load at-rest position. In FIGS. 92 and 93, the embodiment is shown with the marine platform 200 in a compressed position. In FIGS. 94 and 95, the embodiment is shown with the marine platform 200 rolled to starboard relative to the deck 204.

In the embodiment shown in FIGS. 89 through 95, the single three-spar Z-style roll-attenuation pitch-attenuation clevis-mount suspension system 900, includes four struts 206, a roll-attenuation assembly 220, a pitch-attenuation assembly 230, and three spars 270. The three spars 270 are generally arranged in the form of a Z, in that the two outer spars 270 (i.e., the spar 270 that is furthest starboard and the spar 270 that is furthest port) are essentially parallel one to the other, and the middle spar 270 extends essentially diagonally between them, extending from the vicinity of the end of the starboard-side spar 270 mounted to the deck 204 to the vicinity of the end of the port-side spar 270 mounted to the marine platform 200.

As indicated most clearly in FIG. 93, in the single three-spar Z-style roll-attenuation pitch-attenuation clevis-mount suspension system 900, the middle spar 270 and starboard-side spar 270 are mounted to the deck 204 with a spar clevis bracket 274; and the middle spar 270 and port-side spar 270 are mounted to the marine platform 200 with a spar clevis lateral bracket 276.

The following part names and reference numbers are used herein:

marine platform 200
deck 204
struts 206
strut deck bracket 207
strut module bracket 208
roll-attenuation assembly 220
pitch-attenuation assembly 230
torsion bar 240
torsion spring 242
torsion arm 244
adjustable torsion arm 246
torsion arm mounting hole 247
torsion arm link 248
adjustable torsion arm link 250
link bracket 252
torsion-bar mounts 254
bottlescrew 260
spars 270
spar brackets 272
spar clevis bracket 274
spar clevis lateral bracket 276
double-wishbone roll-attenuation suspension system 300
forward wishbone 302
aft wishbone 304
wishbone deck brackets 310
wishbone platform bracket 312
single-wishbone panhard roll-attenuation suspension system 350
panhard assembly 360
panhard rod 362
panhard deck mount 364
panhard platform mount 366
control module 400
double-wishbone suspension system 410
seat 420
helm/control station 422
foot rest 424
foot opening 426
single-wishbone Watt's linkage anti-sway suspension system 450
Watt's linkage 460
Watt's link 462
starboard Watt's rod 464
starboard Watt's rod deck mount 466
port Watt's rod 468
port Watt's rod deck mount 470
double two-spar roll-attenuation suspension system 500
single two-spar panhard roll-attenuation suspension system 550
single two-spar Watt's linkage roll-attenuation pitch-attenuation suspension system 600
single one-spar-two-spar roll-attenuation pitch-attenuation suspension system 650
single two-spar-two-spar roll-attenuation pitch-attenuation suspension system 700
single three-spar-splayed roll-attenuation pitch-attenuation clevis-mount suspension system 750
single three-spar-splayed roll-attenuation pitch-attenuation suspension system 800
single three-spar Z-style roll-attenuation pitch-attenuation suspension system 850
single three-spar Z-style roll-attenuation pitch-attenuation clevis-mount suspension system 900

What is claimed is:

1. A suspension system for a suspended marine platform on a high-speed water vessel having a usual direction of travel, the suspension system comprising:

a shock absorbing assembly for resiliently suspending a marine platform relative to a vessel, wherein the shock absorbing assembly tends to cause the marine platform to remain in an upper at-rest position and to return to the at-rest position on cessation of a force causing the marine platform to move generally vertically towards a bottom position;

two spar assemblies, each spar assembly comprising a first spar and a second spar, each spar pivotally attached at a proximal end to the vessel and at a distal end to the marine platform, wherein:

the proximal ends are aft of the distal ends; and the proximal ends of the spars are spaced athwart one from the other a greater distance than the distal ends of the spars are spaced athwart one from the other; and wherein one spar assembly is forward of the other spar assembly.

2. The suspension system of claim 1, wherein in one of the spar assemblies, the first spar and second spar are fixed one to the other in the vicinity of their distal ends and share a common pivotal attachment to the marine platform.

3. The suspension system of claim 1, wherein one of the spar assemblies further comprises a third spar pivotally attached at a proximal end to the vessel and at a distal end to the marine platform, wherein the proximal end of the third spar is aft of the distal end of the third spar.

4. The suspension system of claim 3, wherein in said one of the spar assemblies, the third spar is generally parallel to the first spar or second spar.

5. The suspension system of claim 4, wherein in said one of the spar assemblies, the spar to which the third spar is generally parallel, is closer to the third spar than the other of the first spar and second spar.

6. The suspension system of claim 1, wherein one of the spar assemblies further comprises a third spar and a fourth spar, each pivotally attached at a proximal end to the vessel and at a distal end to the marine platform, wherein the third spar is adjacent to and parallel with one of the first spar and second spar and the fourth spar is adjacent to and parallel with the other of the first spar and second spar.

7. The suspension system of claim 1, further comprising a roll-attenuation assembly interconnected between the marine platform and the vessel, wherein the roll-attenuation assembly comprises a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel.

8. The suspension system of claim 1, further comprising a pitch-attenuation assembly interconnected between the marine platform and the vessel, wherein the pitch-attenuation assembly comprises a torsion bar mounted so as to extend fore and aft, the torsion bar comprising a torsion spring having at each end an arm extending laterally from the torsion spring, wherein the torsion spring is mounted to one of the marine platform and the vessel, and the arms are each interconnected to the other of the marine platform and the vessel.

9. The suspension system of claim 1, further comprising a panhard interconnected between the marine platform and the vessel so as to limit athwart movement of the marine platform relative to the vessel.

10. The suspension system of claim 1, further comprising a Watt's linkage interconnected between the marine platform and the vessel so as to limit athwart movement of the marine platform relative to the vessel.

11. The suspension system of claim 1, further comprising:

a roll-attenuation assembly interconnected between the marine platform and the vessel, wherein the roll-attenuation assembly comprises a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel; and a panhard interconnected between the marine platform and the vessel so as to limit athwart movement of the marine platform relative to the vessel.

12. The suspension system of claim 1, further comprising:

a roll-attenuation assembly interconnected between the marine platform and the vessel, wherein the roll-attenuation assembly comprises a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel; and a Watt's linkage interconnected between the marine platform and the vessel so as to limit athwart movement of the marine platform relative to the vessel.

13. The suspension system of claim 1, further comprising:

a roll-attenuation assembly interconnected between the marine platform and the vessel, wherein the roll-attenuation assembly comprises a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel; and a pitch-attenuation assembly interconnected between the marine platform and the vessel, wherein the pitch-attenuation assembly comprises a torsion bar mounted so as to extend fore and aft, the torsion bar comprising a torsion spring having at each end an arm extending laterally from the torsion spring, wherein the torsion spring is mounted to one of the marine platform and the vessel, and the arms are each interconnected to the other of the marine platform and the vessel.

14. The suspension system of claim 1, wherein one of the spar assemblies further comprises a third spar pivotally attached at a proximal end to the vessel and at a distal end to the marine platform, wherein the proximal end of the third spar is aft of the distal end of the third spar; and the suspension system further comprises:

a roll-attenuation assembly interconnected between the marine platform and the vessel, wherein the roll-attenuation assembly comprises a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel; and a pitch-attenuation assembly interconnected between the marine platform and the vessel, wherein the pitch-attenuation assembly comprises a torsion bar mounted so as to extend fore and aft, the torsion bar comprising a torsion spring having at each end an arm extending laterally from the torsion spring, wherein the torsion spring is mounted to one of the marine platform and the vessel, and the arms are each interconnected to the other of the marine platform and the vessel.

15. The suspension system of claim 1, wherein one of the spar assemblies further comprises a third spar and a fourth spar, each pivotally attached at a proximal end to the vessel and at a distal end to the marine platform, wherein the third spar is adjacent to and parallel with one of the first spar and second spar and the fourth spar is adjacent to and parallel with the other of the first spar and second spar; and the suspension system further comprises:

a roll-attenuation assembly interconnected between the marine platform and the vessel, wherein the roll-attenuation assembly comprises a torsion bar mounted so as to extend athwart, the torsion bar comprising a torsion spring having at each end an arm extending laterally from the torsion spring, wherein the torsion spring is mounted to one of the marine platform and the vessel, and the arms are each interconnected to the other of the marine platform and the vessel; and a pitch-attenuation assembly interconnected between the marine platform and the vessel, wherein the pitch-attenuation assembly comprises a torsion bar mounted so as to extend fore and aft, the torsion bar comprising a torsion spring having at each end an arm extending laterally from the torsion spring, wherein the torsion spring is mounted to one of the marine platform and the vessel, and the arms are each interconnected to the other of the marine platform and the vessel.

16. The suspension system of claim 1, wherein the shock absorbing assembly comprises four shock-absorbing struts interconnected between the marine platform and the vessel.

* * * * *